US006171746B1

(12) United States Patent
Natsuhara et al.

(10) Patent No.: US 6,171,746 B1
(45) Date of Patent: Jan. 9, 2001

(54) TONER FOR TONER-JETTING

(75) Inventors: Toshiya Natsuhara, Takarazuka; Ken Tanino; Yasuhiro Ohno, both of Ibaraki, all of (JP)

(73) Assignee: Minolta Co., Ltd., Osaka (JP)

( * ) Notice: Under 35 U.S.C. 154(b), the term of this patent shall be extended for 0 days.

(21) Appl. No.: 09/567,524

(22) Filed: May 10, 2000

(30) Foreign Application Priority Data

May 17, 1999 (JP) ..... 10-135669
Apr. 12, 2000 (JP) ..... 12-110902

(51) Int. Cl.[7] ..... G03G 9/08
(52) U.S. Cl. ..... 430/111
(58) Field of Search ..... 430/111

(56) References Cited

U.S. PATENT DOCUMENTS 4,987,454 1/1991 Natsuhara et al. ..... 430/109
5,219,695 * 6/1993 Tanikawa ..... 430/111
5,240,803 8/1993 Ota ..... 430/106
5,310,615 * 5/1994 Tanikawa ..... 430/111
5,474,869 * 12/1995 Tomita et al. ..... 430/111
5,477,250 12/1995 Larson ..... 347/55
5,851,716 * 12/1998 Kuramoto et al. ..... 430/111
5,858,593 * 1/1999 Tamura et al. ..... 430/111
6,063,535 * 5/2000 Tsutsui et al. ..... 430/111
6,077,635 * 6/2000 Okado et al. ..... 430/111
6,096,465 * 8/2000 Kadokura et al. ..... 430/111

* cited by examiner

*Primary Examiner*—Roland Martin
(74) *Attorney, Agent, or Firm*—Burns, Doane, Swecker & Mathis, LLP

(57) ABSTRACT

The present invention relates to a toner used in a toner-jetting system wherein the toner is jettingly adhered to a recording medium in a direct manner, said toner satisfying a specific relationship between an average quantity of charge (x)($\mu$C/g) and a distribution deviation of quantity of charge (y).

32 Claims, 11 Drawing Sheets

TONER FOR TONER-JETTING

This application is based on application Nos. 135669/1999 and 110902/2000 filed in Japan, the contents of which are hereby incorporated by reference.

BACKGROUND OF THE INVENTION

1. Field of the Invention

The present invention relates to a toner for a toner-jetting system wherein a toner-supporting member and a recording medium, such as paper and the like are maintained in a non-contact state, and a charged toner from the toner-supporting member is jettingly adhered to the recording medium in a direct manner to form an image.

2. Description of the Related Art

Conventionally, electrophotographic apparatuses have been generally used as apparatuses for copying (printing) images such as letters and graphics. However, in the electrophotographic apparatuses, an electrostatic latent image is formed on the surface of an image-supporting member (photosensitive member), and toner is allowed to adhere to the electrostatic latent image on the image-supporting member so as to visualize the electrostatic latent image, thereby temporarily forming an image; thereafter, the resulting toner image on the image supporting-member is transferred to a recording medium. Therefore, such a system makes the apparatus size bulky and the cost higher.

For this reason, a toner-jetting system (direct recording method) has been proposed in which: a recording electrode and a back electrode are placed face to face with a toner-supporting member; a recording medium such as paper is transported between the recording electrode and the back electrode; a voltage corresponding to an image signal is applied to the recording electrode so that an electrostatic force is exerted on the toner; and in accordance with the voltage-applied state, the toner from the toner-supporting member is jettingly adhered to the recording medium in a direct manner.

However, in such a toner-jetting system, when the toner flies from the toner-supporting member to the recording medium, the toner is forced to pass through a number of holes in the recording electrode, with the result that problems arise in which upon flying from the toner-supporting member to the recording medium, the toner adheres to the recording electrode (FPC stain), resulting in clogging in the holes of the recording electrode.

Moreover, the above-mentioned recording system also causes problems with image quality in the resulting images. For example, when dots are printed, a phenomenon tends to occur (referred to as "tailing") in which the dots are extended and distorted in the transporting direction of paper, or when lines are printed, a problem arises in which line edges become dull or the toner particles scatter on paper area between lines (problem with convergence). Moreover, another problem arises in which when the toner flies to the recording medium from the toner-supporting member, the toner is not separated from the toner supporting-member smoothly, resulting in a reduction in the image density (problem with separating property).

SUMMARY OF THE INVENTION

The present invention has been devised to solve the above-mentioned problems, and its objective is to provide a toner for toner-jetting, which is superior in image quality, converging property and separating property, and which is not susceptible to clogging, tailing and a reduction in density.

Another objective of the present invention is to provide a method for using a toner for toner-jetting which can provide good images in quality, and which are not susceptible to clogging, tailing and a reduction in density.

The first invention relates to a toner used in a toner-jetting system wherein the toner is jettingly adhered to a recording medium in a direct manner, said toner satisfying a specific relationship between an average quantity of charge (x)($\mu$C/g) and a distribution deviation of quantity of charge (y).

The second invention relates to a toner used in a toner-jetting system wherein the toner is jettingly adhered to a recording medium in a direct manner, said toner having a specific distribution of a particle size, and satisfying a relationship between an average quantity of charge (x)($\mu$C/g) and a distribution deviation of quantity of charge (y).

The third invention relates to a toner used in a toner-jetting system wherein the toner is jettingly adhered to a recording medium in a direct manner, said toner having a specific average roundness, and satisfying a specific relationship between an average quantity of charge (x)($\mu$C/g) and a distribution deviation of quantity of charge (y).

The fourth invention relates to a toner used in a toner-jetting system wherein the toner is jettingly adhered to a recording medium in a direct manner, said toner having a specific distribution of a particle size and a specific average roundness, and satisfying a specific relationship between an average quantity of charge (x)($\mu$C/g) and a distribution deviation of quantity of charge (y).

DETAILED DESCRIPTION OF THE INVENTION

The toner of the first invention is designed so that the relationship between the average quantity of charge (x) and the distribution deviation of quantity of charge (y) satisfies the following expressions:

$y \leqq 4.17|x| + 2.68$ (first expression)

$y \geqq 1.43|x| + 1.13$ (second expresssion).

Figure 1:
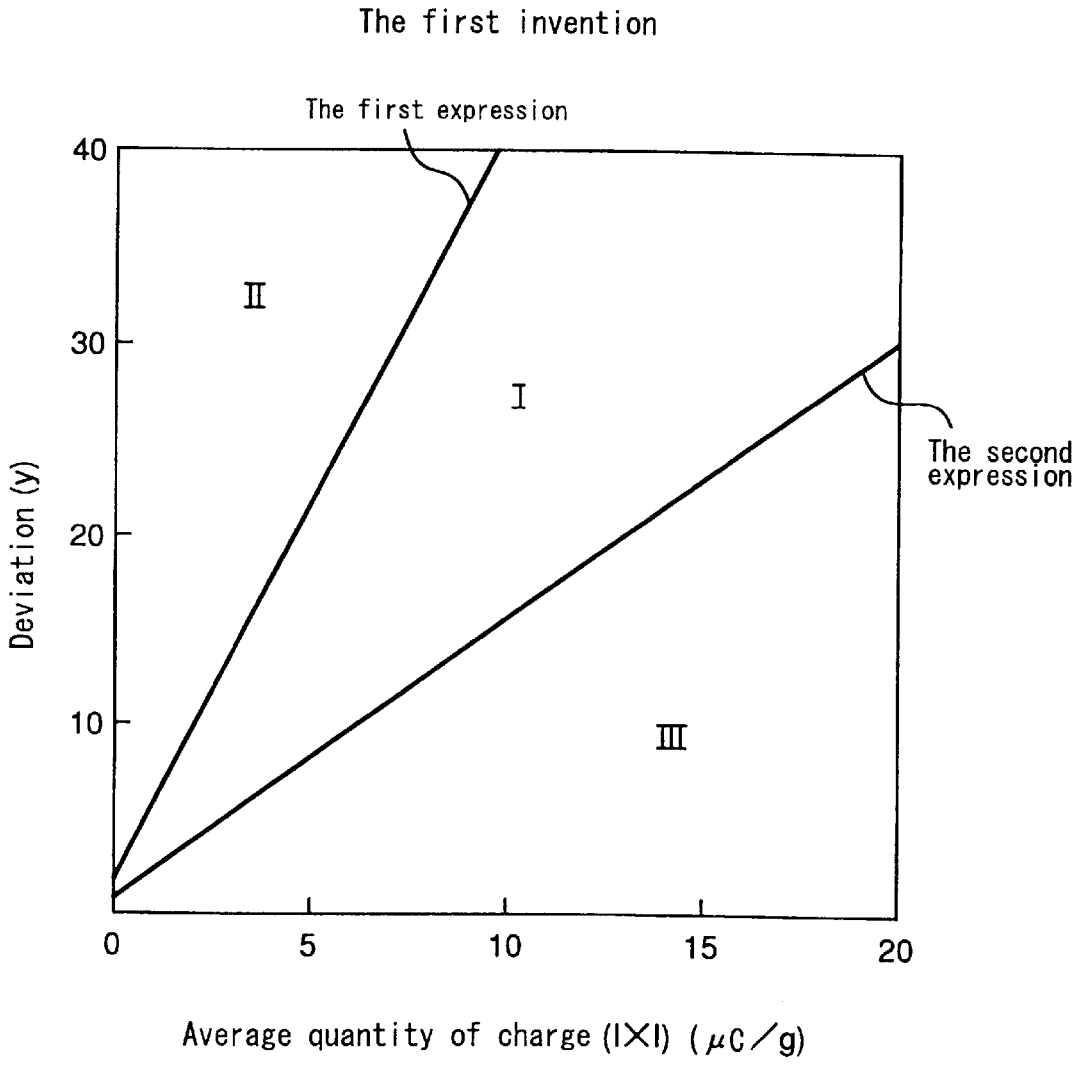
FIG. 1 is a conceptual drawing that shows expressions of the first invention.

Although the toner quantity of charge is dependent on charging conditions such as a blade pressure, an applied voltage, a blade material, and a sleeve material, the toner of the first invention is only required to satisfy the above-mentioned expressions on a toner layer formed on a toner-supporting member. In other words, the toner of the first invention is only required to satisfy the above-mentioned expressions on the toner-supporting member at the time of jetting the toner from the toner-supporting member to the recording medium. More concretely, as shown in FIG. 1, the toner of the first invention has its (|x|, y) (x: average quantity of charge ($\mu$C/g), y: distribution deviation of quantity of charge) set within area I (including the border) on the toner supporting-member. Here, |x| refers to an absolute value of the average quantity of charge (x), and x may be either a positive or negative value. Moreover, FIG. 1 shows a case in which |x| is set in the range of 0 to 20 $\mu$C/g; however, it is not limited by this range as long as it satisfies the above-mentioned expressions.

When the toner does not satisfy the first expression, that is, when its (|x|, y) is located within area II in FIG. 1, problems of tailing and FPC stain arise. It is considered that when the toner is in area II, the quantity of charge of the toner has relatively greater variations, causing a delay in flying response in toner particles having relatively small quantity of charge, and the subsequent tailing. Moreover, when the toner quantity of charge has great variations, oppositely charged toner particles and toner particles having extremely high quantity of charge are more likely to be generated; consequently, these toner particles adhere to recording electrodes (FPC stain), resulting in problems such as clogging.

When the toner does not satisfy the second expression, that is, when its (|x|, y) is located within area III in FIG. 1, problems with the toner particle converging property and separating property arise. Since the toner located within area III has a relatively small distribution deviation of quantity of charge, there is an extreme increase in the repulsive force between toner particles at the time of flying, resulting in the problem with the convergence. Moreover, since toner particles separated from the toner supporting-body have a smaller deviation in the distribution of quantity of charge and since their flying response is virtually the same, the individual toner particle flow into holes in the same manner, thereby causing a high probability of clogging. Furthermore, in the case when the distribution deviation of quantity of charge is relatively small, the adhesive force of toner particles to the supporting member becomes greater uniformly when the toner average quantity of charge is relatively great. Therefore, it becomes more difficult to separate the toner from the supporting member, and this causes the problem with the separation property, and the subsequent reduction in density.

In the present specification, with respect to the average quantity of charge and the distribution deviation of quantity of charge of the toner, the values are used which were obtained by measuring a toner (toner layer) that was formed on a toner-supporting member (an intermediate roller; a toner-supplying roller, if no intermediate roller is installed) under the following setting conditions in a printing apparatus of FIG. 6 which will be described later. However, the present invention is not intended to be limited thereby. In other words, with respect to the average quantity of charge and the distribution deviation of quantity of charge of the toner, the values may be used which were obtained by using the toner (toner layer) on the toner-supporting member that is formed on an actual printing apparatus under actual setting conditions to which the toner is applied.

Figure 6:
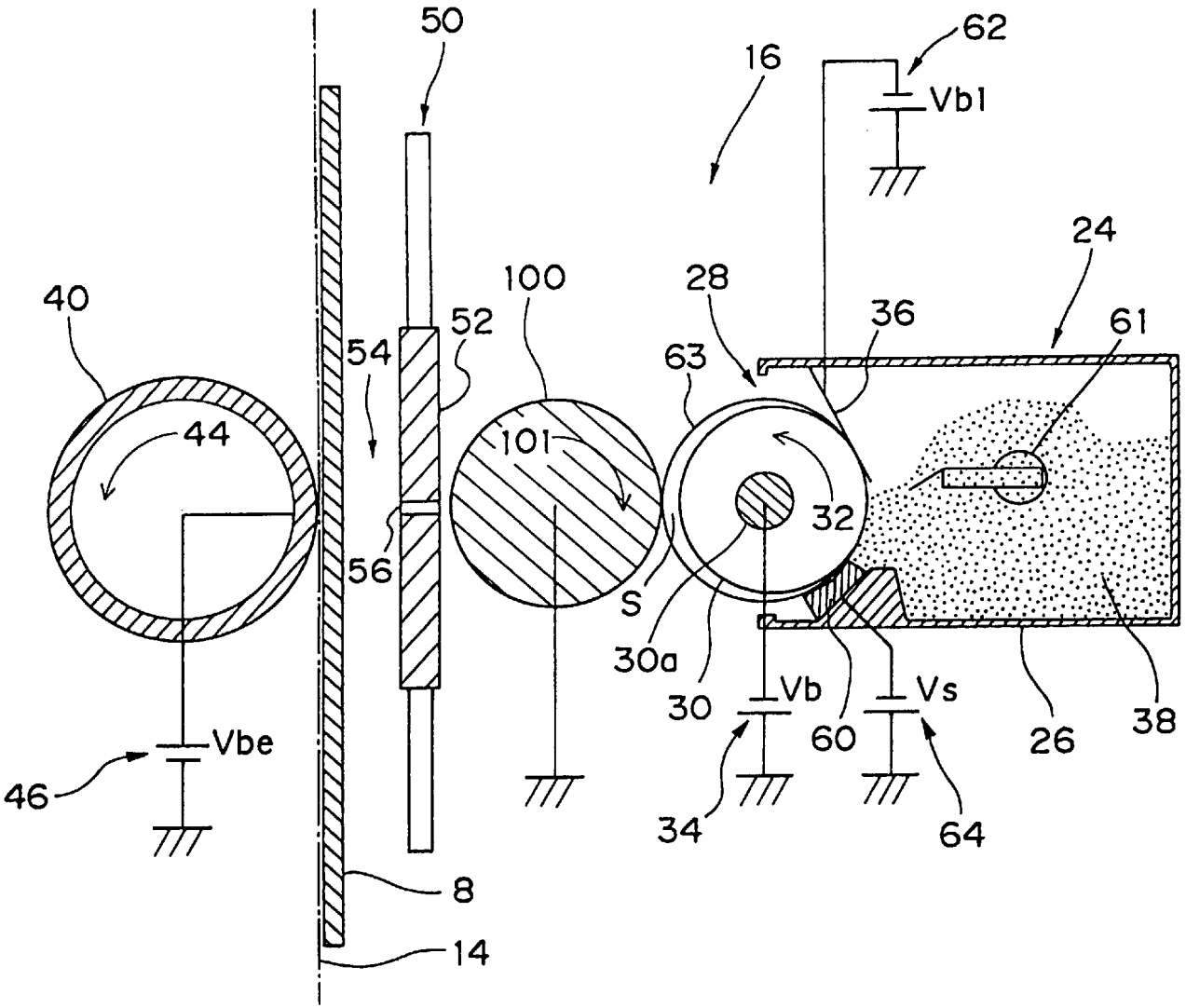
FIG. 6 is a schematic view showing the constructions of a printing station, a printing head and a back roller in the apparatus of FIG. 5.
Figure 7:
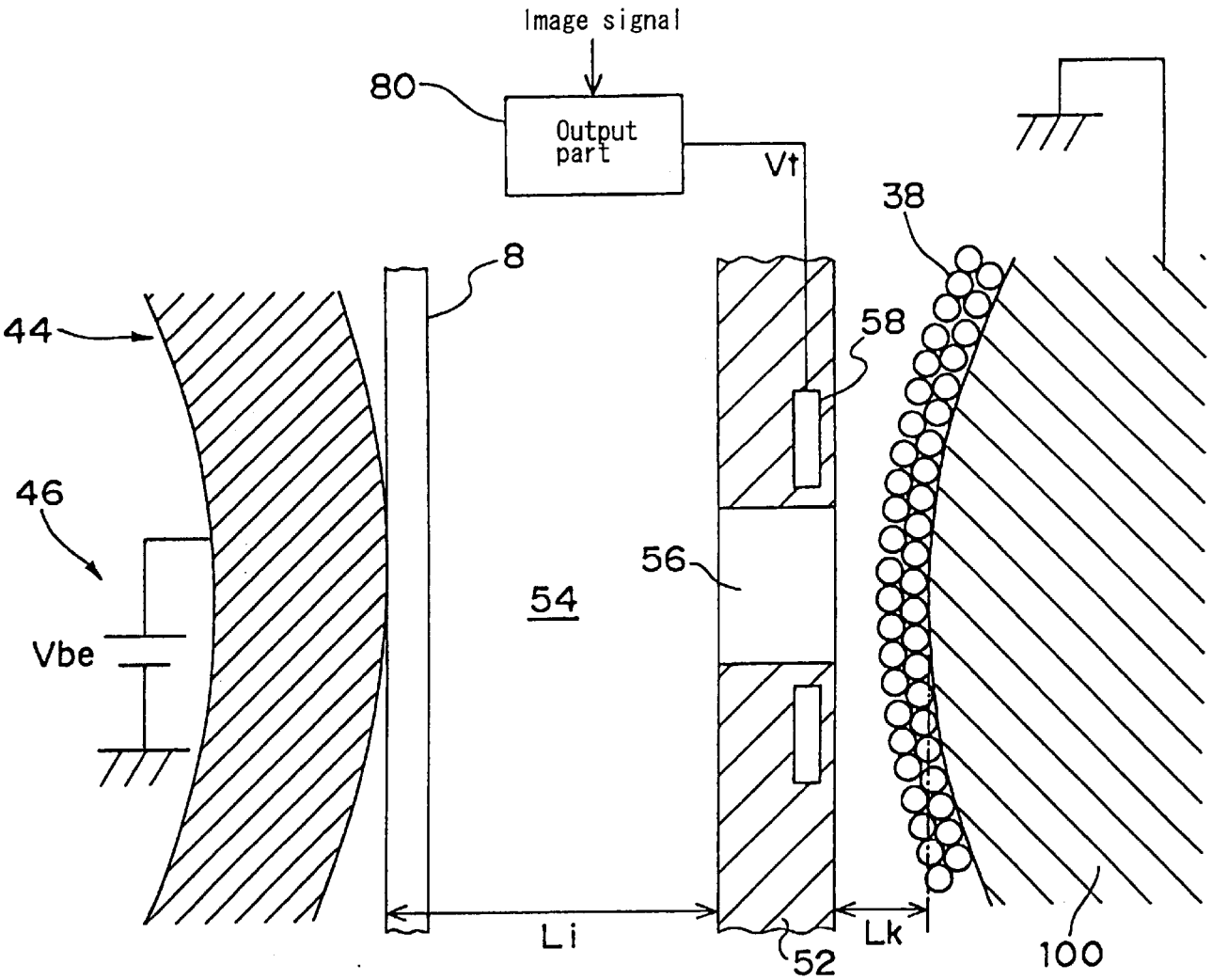
FIG. 7 is a schematic enlarged view that shows the proximity of a printing area in FIG. 6.
Figure 8:
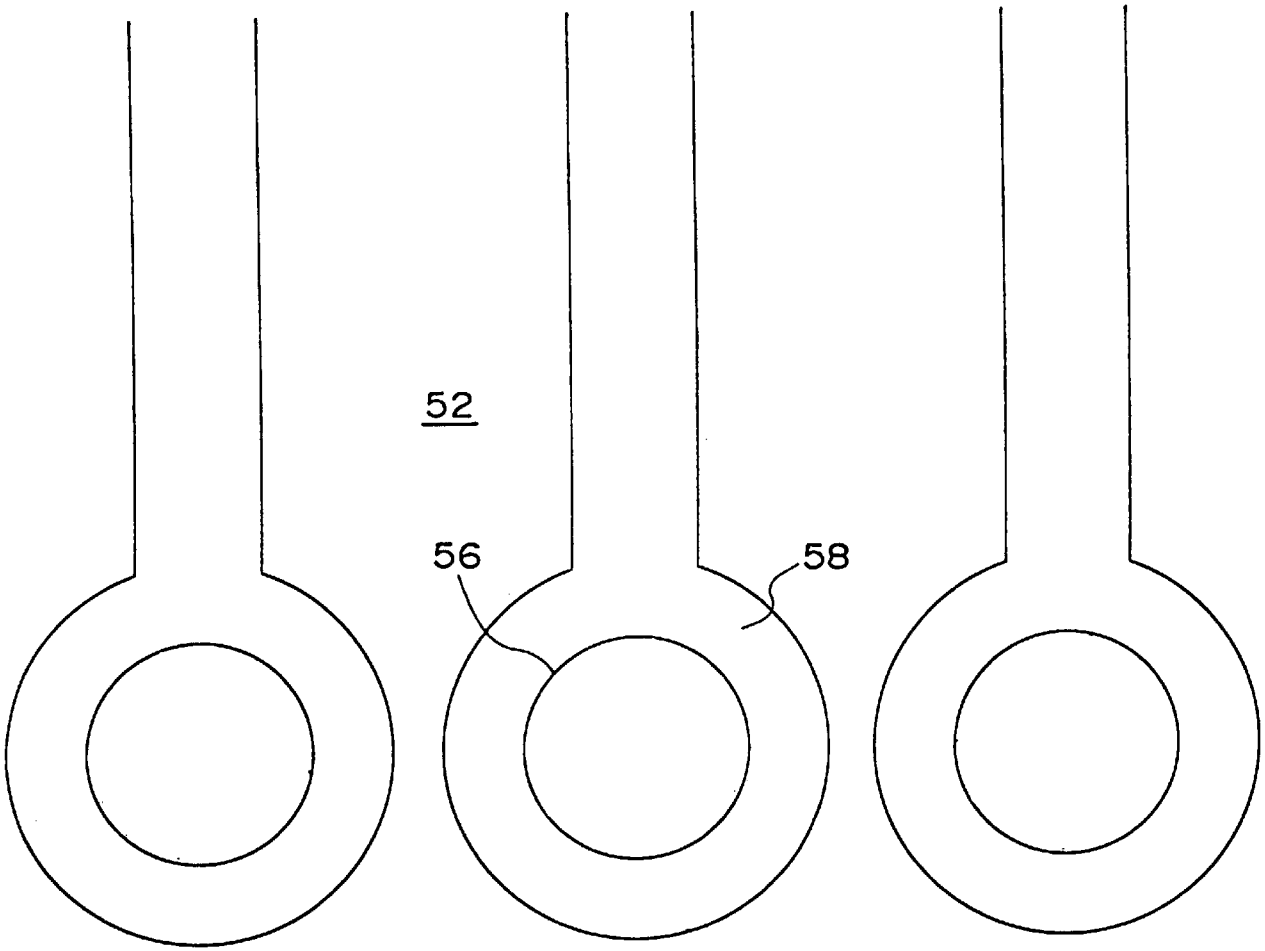
FIG. 8 is a schematic enlarged view that shows holes explaining recording electrodes.
Figure 9:
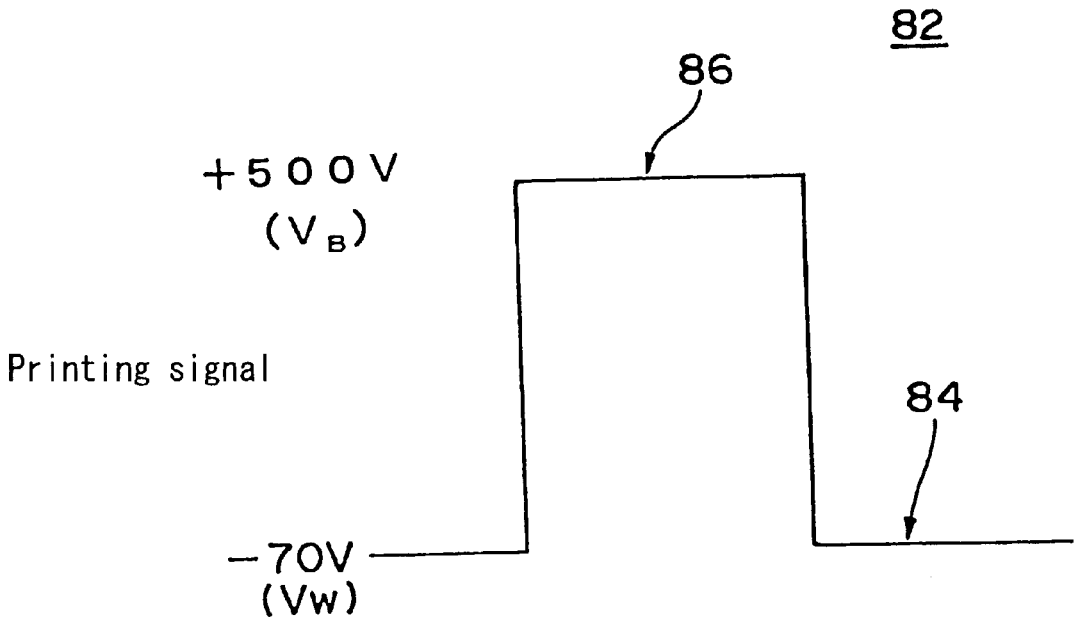
FIG. 9 shows one example of a voltage waveform of a printing signal.

Setting conditions (Abbreviation symbols; see FIGS. 6, 7 and 9)

Mechanical setting: Lk; 90 $\mu$m, Li; 200 $\mu$m

Electrical setting: Recording electrode potential ($V_B$ (ON time); +500 V, $V_W$ (OFF time): −70 V), Back roller potential (Vbe); 1000 V, Supply roller potential (Intermediate roller potential); 0 V, Vb; −15 V, Vs=Vb, Vb1; Vb −200 V Intermediate roller amount of adhesion: approximately 0.8 mg/cm$^2$ Respective roller velocities: Sleeve peripheral velocity; 79.8 mm/s, Intermediate roller peripheral velocity; 202.6 mm/s, Back roller peripheral velocity (Paper feeding speed); 104.2 mm/s FPC used; 4 row, 300 dpi (thickness 110 $\mu$m, diameter of hole 140 $\mu$m)

Blade pressure; 4 g/mm or 6 g/mm.

In other words, even if any device and any conditions are used as the printing apparatus and setting conditions to which any toner is applied, the average quantity of charge and the distribution deviation of quantity of charge of the toner (toner layer) on the toner-supporting member that is formed on an actual printing apparatus under actual setting conditions to which the toner is applied satisfy the above-mentioned expressions, the toner is included within the scope of the first invention. For example, even in the case when any toner is applied to a printing apparatus that uses setting conditions (which is supposed to be conditions x) different from the above-mentioned setting conditions, if the printing apparatus adopts a toner-jetting system and if the toner (toner layer) on a toner supporting-member formed under the conditions x is used and measured an average quantity of charge and a distribution deviation of quantity of charge that satisfy the above-mentioned expressions the toner is considered to be included within the scope of the first invention.

In the present specification, the average quantity of charge and the distribution deviation of the quantity of charge of the toner were obtained by measuring the toner collected from the toner supporting-member by using an E-spart analyzer (E-SPART-2; made by Hosokawa Micron K.K.). Here, in the present invention, the measuring device for the average quantity of charge and the distribution deviation of the quantity of charge of the toner is not limited by the above-mentioned device; and any device may be used, as long as the measurements are carried out based upon the principle of the above-mentioned device. The device setting conditions are described as follows:

GASS SUPPLY: 0.2 to 0.4 kgf/cm$^2$

AIR FLOW: −0.03

FEED CONDITION

INTERVAL: 1 sec

PULSE DURATION: 3 sec.

RUNNING TIME: 450 m

PM VOLTAGE: 5.35 kV

In the first invention, |x| and y are not particularly limited, as long as they satisfy the above-mentioned expressions. However, |x| is preferably set in the range of 0 to 60 $\mu$C/g, more preferably, 0 to 40 μC/g, and most preferably, 0 to 20 μC/g, and y is preferably set in the range of 0 to 120, more preferable, 0 to 80, and most preferably, 0 to 40.

Moreover, in the first invention, the average degree of roundness of the toner and the ratio of content of toner having a particle size of not less than 9 μm, which will be described later, are not particularly limited. The toner volume-average particle size (hereinafter, referred to simply as the average particle size) ($D_{50}$) is not particularly limited, and this is determined, taking into consideration systematically factors such as the prevention of clogging, control of the average quantity of charge and improvements in printed image quality. In general, the average particle size is set to not more than 10 μm, and more preferably, not more than 8 μm; and the smaller this is, the more preferable.

The above-mentioned toner of the first invention may be manufactured by using any method including, for example, a pulverizing method and a wet method, as long as the average quantity of charge and the distribution deviation of the quantity of charge satisfy the above-mentioned expressions.

For example, the toner of the present invention is obtained as follows. At least a binder resin and a colorant, as well as wax and a charge control agent, if necessary, are sufficiently mixed, and kneaded in a molten state, and after having been cooled off, this is coarsely pulverized and finely ground, and then classified. Moreover, the toner of the present invention may be manufactured by using any known wet methods including, for example, the emulsion dispersing granulation method, the suspension polymerization method and the emulsion polymerization method. However, from the viewpoint of production costs and ease in production, it is preferable to use the above-mentioned pulverizing method.

More specifically, in the case when the toner of the present invention is manufactured by using a pulverizing method, at least a binder resin and a colorant, as well as a wax and a charge control agent, if necessary, are loaded into a mixing device, such as a ball mill, a V-type mixing machine, a Henschel Mixer, a high-speed dissolver, an internal mixer, a screw-type extruder and a fall bag, and mixed and dispersed therein. Next, the mixed matter is heated and kneaded by using a pressure kneader, a twin screw extruder kneader, or a roller, etc. The obtained kneaded matter is coarsely pulverized by means of a pulverizing machine, such as a hammer mill, a jet mill, a cutter mill, and a roller mill. Moreover, after having been finely ground by a pulverizing machine such as, for example, a jet mill and a high-speed rotary pulverizing machine, this is classified by, for example, a wind-force classifier or an air-flow-type classifier into a desired particle size; thus, toner particles are obtained.

With respect to the binder resins which may be used in the present invention, the following resins are exemplified: monopolymer of styrene and its substituted compounds, such as polystyrene, poly-p-chlorostyrene and polyvinyltoluene; styrene-based copolymers, such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene-maleic acid copolymer, and styrene-maleic acid ester copolymer; acrylic resins, such as polyacrylate, polymethyl methacrylate, polyethyl methacrylate, poly-n-butyl methacrylate, polyglycidyl methacrylate, and polyacrylate containing fluorine; polyvinyl chloride, polyvinyl acetate, polyethylene, polypropylene, polyester, polyurethane, polyamide, epoxy resins, polyol resins, polyvinyl butylate, polyacrylic resins, rosin, denatured rosin, terpene resins, phenol resins, urea resins, aliphatic or alicyclic hydrocarbide resins, aromatic petroleum resins, chlorinated paraffin, paraffin wax, and the like. These are solely used or some of these may be used in a mixed manner, while taking into consideration a fixing property and a property to form a toner layer.

With respect to colorants contained in the toner of the present invention, selection is made from the following materials while taking into consideration the tone and durability required, the dispersing property to a binder resin selected, etc.; however, the present invention is not intended to be limited thereby.

Examples thereof include: in addition to carbon black (furnace black, Ketchen black, Lump Black, Thermal Black, Channel Black, etc.), dye pigments, such as phthalocyanine-based, azo-based, monoazo-based, disazo-based, azomethine-based, quinacridon-based, perylene-based, anthrapyrimidine-based, isoindolinone-based, thren-based, benzidine-based, naphthol-based, and xanthene-based dyes, more specifically, chrome yellow, azolake, iron oxide red, titanium oxide, molybdenum red, ultramarine blue, phthalocyanine blue, aniline blue, Phorone Yellow, rhodamine 6G, Lake, Chalco Oil Blue, thioindigo, chrome yellow, quinacridon, benzidine yellow, Hansa Yellow G, Rose Bengal, triallyl methane, etc. Any of known dye pigments may be used solely, or in a mixed manner. The amount of use of these colorants is normally set in the range of 1 to 30 parts by weight, and more preferably, 3 to 20 parts by weight, with respect to 100 parts by weight of the binder resin.

Moreover, in order to add a mold-releasing property to the toner, various mold-releasing agents may be added in a combined manner. In particular, wax may be added in order to improve properties such as anti-offset property, etc. Examples of such wax include: polyethylene wax, polypropylene wax, carnauba wax, rice wax, sazol wax, montan ester waxes, carnauba wax, Fischer-Tropsch wax, etc. In the case of addition of a wax to the toner, the content is preferably set in the range of 0.5 to 5 parts by weight to 100 parts by weight of the binder resin; thus, it becomes possible to obtain the effects of the addition without causing disadvantages, such as filming, etc. The above-mentioned waxes may be used solely or in combination, and when used in combination, the total amount of those waxes is preferably set in the above-mentioned range.

With respect to the charge control agent used in the present invention, the following substances may be used, while taking into consideration the tone and the quantity of charge of the toner. Examples thereof include: nigrosine dyes, alcoxylated amine, quaternary ammonium salts, alkyl amide, metallic complexes of azo-based dyes, tetraphenylboron derivatives, salicylic acid derivative Zn salts, metallic complexes of alkylsalicylic acid, metallic salts of higher fatty acids, etc.; and these are used. These contents are not particularly limited, as long as the average quantity of charge and distribution deviation of quantity of charge of the toner satisfy the above-mentioned expressions. In general, the amount of addition is in the range of 1 to 10 parts by weight, and more preferably, 2 to 8 parts by weight, with respect to 100 parts by weight of the binder resin.

The toner average quantity of charge and the distribution deviation of the quantity of charge can be controlled by adding/mixing a post-treatment agent and a conductivity treatment agent to/with the toner particles obtained as described above or appropriately adjusting the average primary particle size of the post-treatment agent and the conductivity treatment agent, and the average particle size and the particle size distribution of the toner particles, etc. Hereinafter, factors by which the average quantity of charge and the distribution deviation of quantity of charge can be controlled are referred to simply as control factors.

With respect to the post-treatment agent, the following conventionally known materials in the field of toner-jetting are listed: silica fine particles (silicon dioxide, aluminum silicate, sodium silicate, potassium silicate, zinc silicate, magnesium silicate, etc.), titanium oxide, aluminum oxide, tin oxide, antimony oxide, zirconium oxide, strontium titanate, barium titanate, etc. Examples of other post-treatment agents include: cleaning aids consisting of resin powder, such as polymethyl methacrylate, fluoropolymers (polyvinylidene fluoride, polytetrafluoroethylene), anti-caking agents, fixing aids such as low molecule polyolefin, or lubricants for preventing anchored developing blades such as metal salts of fatty acids (lead stearate, aluminum stearate), etc., and these may be appropriately added. Here, these post-treatment agents may be used solely or may be used in combination. Moreover, these post-treatment agents may be subjected to a surface treatment such as a hydrophobic treatment. By using two kinds of post-treatment agents, it is possible to avoid clogging and also to improve image quality (improvements in separating property and converging property). In particular, the application of silica improves the fluidity, and ensures a low degree of aggregation in the toner powder property, and the application of titanium makes it possible to adjust the quantity of charge.

The amount of the post-treatment agent is appropriately set depending on a desired average quantity of charge of the toner and other control factors, such as the average primary particle sizes of the post-treatment(s) agents and the conductivity treatment agents, the average particle size of the toner particles and the particle size distribution, and it is not particularly limited. However, it is preferable to set the ratio in the range of 0.1 to 5% by weight, and more preferably, 0.3 to 3% by weight, with respect to the toner particles. In the case of application of two kinds or more of post-treatment agents, the total amount of addition is preferably set in the above-mentioned range.

Examples of the conductivity treatment agents include carbon, zinc oxide, etc. These conductivity treatment agents may be used solely or may be used in combination. Here, these conductivity treatment agents may be subjected to a surface treatment such as a hydrophobic treatment.

The amount of the conductivity treatment agent is appropriately set depending on a desired toner average quantity of charge and other control factors, such as the average primary particle sizes of the post-treatment agents and the conductivity treatment agents, the average particle size of the toner particles and the particle size distribution, and it is not particularly limited. However, it is preferable to set the ratio in the range of 0.1 to 5% by weight, and more preferably, 0.2 to 2% by weight, with respect to the toner particles. In the case of application of two kinds or more of conductivity treatment agents, the total amount of addition is preferably set in the above-mentioned range.

With respect to means for mixing the post-treatment agent and conductivity treatment agent, a known mixing device may be used, and for example, a high-speed flowing-type mixing device is preferably used. With respect to the high-speed flowing-type mixing device, examples thereof include a Henschel Mixer, a super mixer, a micro speed mixer, etc. After the post-treatment agents have been added and mixed, it is preferable to remove aggregations and mixtures by using a sieve.

In general, as the average particle size of the toner particles becomes greater, the average quantity of charge decreases, and as the average particle size becomes smaller, the average quantity of charge increases. With respect to the average particle size, since consideration should be taken not only from the viewpoint of a desired toner average quantity of charge and other control factors, but also from the viewpoint of the above-mentioned clogging prevention, control of the average quantity of charge and improvement in printed image quality, it is not easily determined; however, it is preferable to set it in the above-mentioned range. The toner average particle size is controlled by properly adjusting the pulverizing conditions (including types of the pulverizing device, etc.) and classifying conditions (including types of the classifier, etc.) at the time of production.

With respect to the particle size distribution of toner particles, when the toner particle size is uniformed, the distribution deviation of the quantity of charge generally decreases. The distribution of the toner particle size is properly determined depending on a desired deviation and other control factors, and this is not particularly limited; however, it is preferable that toner particles of not less than 60% by weight, and more preferably, not less than 80% by weight, with respect to the total toner particles be located within a particle width of 5 $\mu$m in the particle size distribution. Since it becomes possible to prevent large-size particles from being contained by sharpening the particle-size distribution; consequently, the following effects are obtained: Scattering in the resulting printed image is further prevented and the converging property is improved. The toner average particle size is controlled by properly adjusting the pulverizing conditions (including types of the pulverizing device, etc.) and classifying conditions (including types of the classifier, etc.) at the time of production.

Moreover, the toner average quantity of charge and the distribution deviation of quantity of charge may be controlled by appropriately selecting the kinds and the amounts of addition of toner components constituting the toner, such as, for example, a binder resin, a colorant, wax and a charge-control agent.

The toner of the second invention is designed so that a ratio of content of toner having a particle size of not less than 9 $\mu$m is not more than 20% by weight and the relationship between the average quantity of charge (x) and the distribution deviation of quantity of charge (y) satisfies the following expressions:

$$y \leqq 4.17|x| + 2.68 \quad \text{(third expression)}$$

$$y \geqq 1.14|x| + 1.13 \quad \text{(fourth expresssion).}$$

Figure 2:
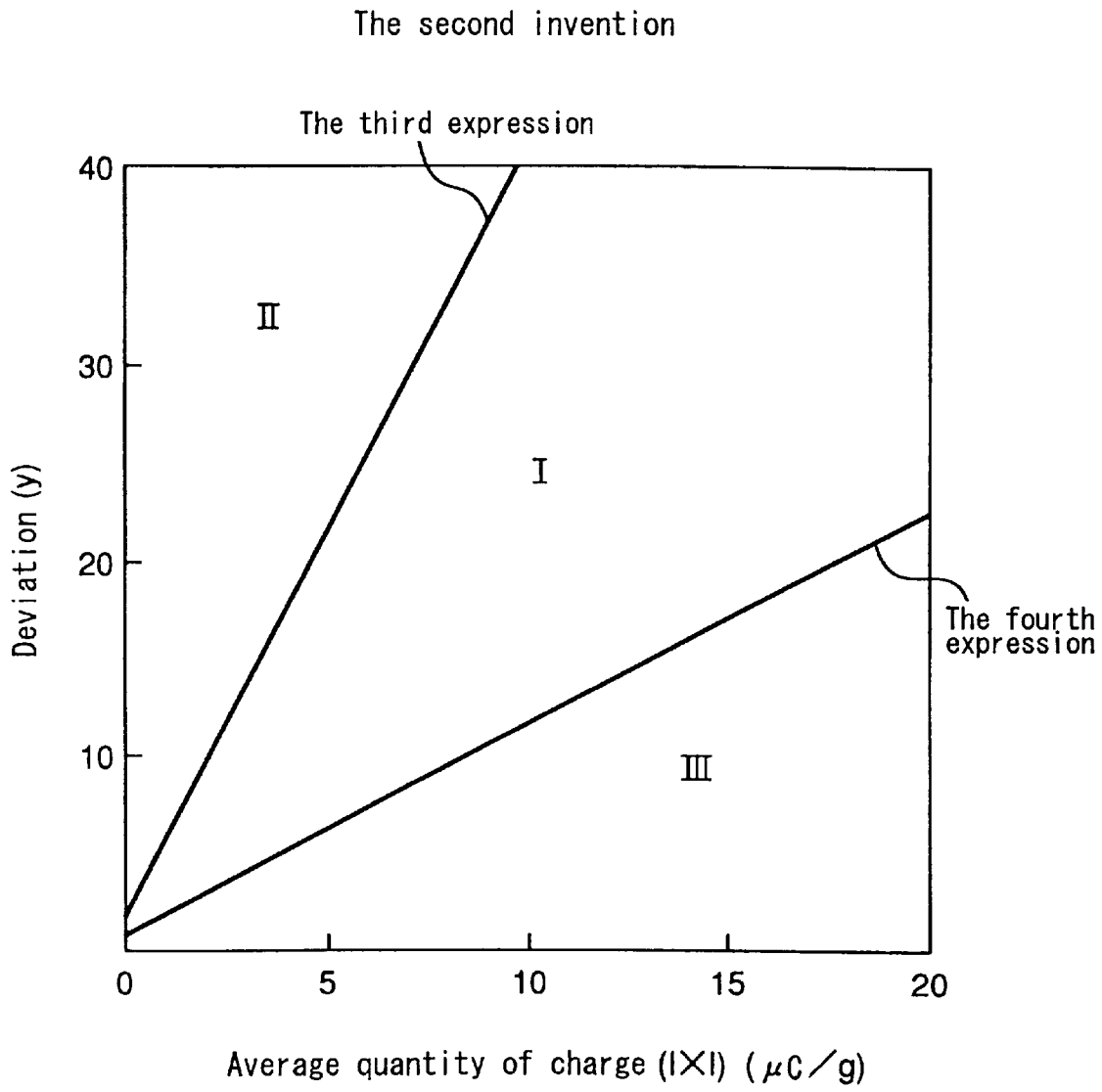
FIG. 2 is a conceptual drawing that shows expressions of the second invention.

Although the toner quantity of charge is dependent on charging conditions such as a blade pressure, an applied voltage, a blade material and a sleeve material, the toner of the second invention is only required to satisfy the above-mentioned expressions on a toner layer formed on a toner-supporting member. In other words, the toner of the second invention is only required to satisfy the above-mentioned expressions on the toner supporting-member at the time of jetting the toner from the toner-supporting member to the recording medium, and also is only required to have a ratio of content of toner having a particle size of not less than 9 μm in the above-mentioned range. More specifically, in the case when the ratio of content of toner having a particle size of not less than 9 μm is set in the above-mentioned range, as illustrated in FIG. 2, the toner of the second invention has its (|x|, y) (x: average quantity of charge (μC/g), y: distribution deviation of quantity of charge) set within area I on the toner supporting-member. Area I indicates an area surrounded by a solid line based upon the above-mentioned expressions. In the same manner as the first invention, |x| refers to an absolute value of the average quantity of charge (x), x may be either a positive or negative value. Moreover, FIG. 2 shows a case in which |x| is set in the range of 0 to 20 μC/g; however, it is not limited by this range as long as it satisfies the above-mentioned expressions.

When the toner does not satisfy the third expression, that is, when its (|X|, y) is located within area II in FIG. 2, problems of tailing and FPC stain arise. It is considered that when the toner is in area II, the quantity of charge of the toner has relatively greater variations, causing a delay in flying response in toner having relatively small quantity of charge, and the subsequent tailing. Moreover, when the toner quantity of charge has great variations, oppositely charged toner particles and toner particles having extremely high quantity of charge are more likely to be generated; consequently, these toner particles adhere to recording electrodes (FPC stain), resulting in problems such as clogging.

When the toner does not satisfy the fourth expression, that is, when its (|x|, y) is located within area III in FIG. 2, problems with the toner particle converging property and separating property arise. Since the toner located within area III has a relatively small distribution deviation of quantity of charge, there is an extreme increase in the repulsive force between toner particles at the time of flying, resulting in the problem with the convergence. Moreover, since toner particles separated from the toner supporting-member have a smaller deviation in the distribution of quantity of charge and since their flying response is virtually the same, the individual toner particle flows into holes in the same manner, thereby causing a high probability of clogging. Furthermore, in the case when the distribution deviation of quantity of charge is relatively small, the adhesive force of toner particles to the supporting member becomes greater uniformly when the toner average quantity of charge is relatively great. Therefore, it becomes more difficult to separate the toner from the supporting member. This causes the problem with the separation property, and the subsequent reduction in density.

With respect to the toner used in measurements on the average quantity of charge and distribution deviation of quantity of charge as well as the measuring method and setting conditions of the devices, those which are the same as the first invention are used.

Therefore, even if any device and any conditions are used as the printing apparatus and setting conditions to which any toner is applied, the average quantity of charge and the distribution deviation of quantity of charge of the toner (toner layer) on the toner-supporting member that is formed on an actual printing apparatus under actual setting conditions to which the toner is applied satisfy the above-mentioned expressions and if "its ratio of content of toner having a particle size of not less than 9 μm", which will be described later, is located within a specific range, the toner is included within the range of the second invention.

In the second invention, the preferably ranges of |x| and y are the same as those ranges in the first invention.

In the second invention, when the ratio of content of toner having a particle size of not less than 9 μm exceeds 20% by weight, area I in which (|x|, y) of the toner is allowed to exist is narrowed. More specifically, it becomes the same as area I in the first invention.

In the present specification, with respect to the ratio of content of toner (% by weight) having a particle size of not less than 9 μm, values obtained through measurements carried out by using a Coulter Counter Multisizer (made by Coulter Co., Ltd.) were used. Here, in the present invention, the particle size distribution is not necessarily measured by the above-mentioned device; and the measurements may be carried out by any device as long as the values are obtained based upon the principle of the above-mentioned device.

Moreover, in the second invention, the average degree of roundness of the toner, which will be described later, is not particularly limited. The toner volume-average particle size (hereinafter, referred to simply as the average particle size) ($D_{50}$) is not particularly limited, and this is determined, taking into consideration systematically factors such as the prevention of clogging, control of the average quantity of charge and improvements in printed image quality. In general, the average particle size is set to not more than 10 μm, and more preferably, not more than 8 μm; and the smaller this is, the more preferable.

As described above, the toner of the second invention may be manufactured by using any method as long as the ratio of content of toner having a particle size of not less than 9 μm is located within the desired range, and as long as the average quantity of charge and the distribution deviation of quantity of charge satisfy the above-mentioned expressions.

For example, in the second toner, toner particles may be obtained in the same manufacturing method as the first toner, and the second toner may be obtained by classifying these by using a classifying device such as, for example, a DS classifier (made by Nippon Pneumatic MFG).

With respect to the controlling methods of the average quantity of charge and the distribution deviation of quantity of charge in the second toner, the same methods as used in the toner of the first invention may be adopted.

With respect to the toner components constituting the second toner, for example, a binder resin, a colorant, wax and a charge control agent, the same components as in the first toner may be used.

The toner of the third invention is designed so that the average degree of roundness of toner is set in the range of 0.954 to 0.992 and the relationship between the average quantity of charge (x) and the distribution deviation of quantity of charge (y) satisfies the following expressions:

$$y \leqq 4.17|x| + 2.68 \quad \text{(fifth expression)}$$

$$y \geqq 0.98|x| + 1.13 \quad \text{(sixth expresssion).}$$

Figure 3:
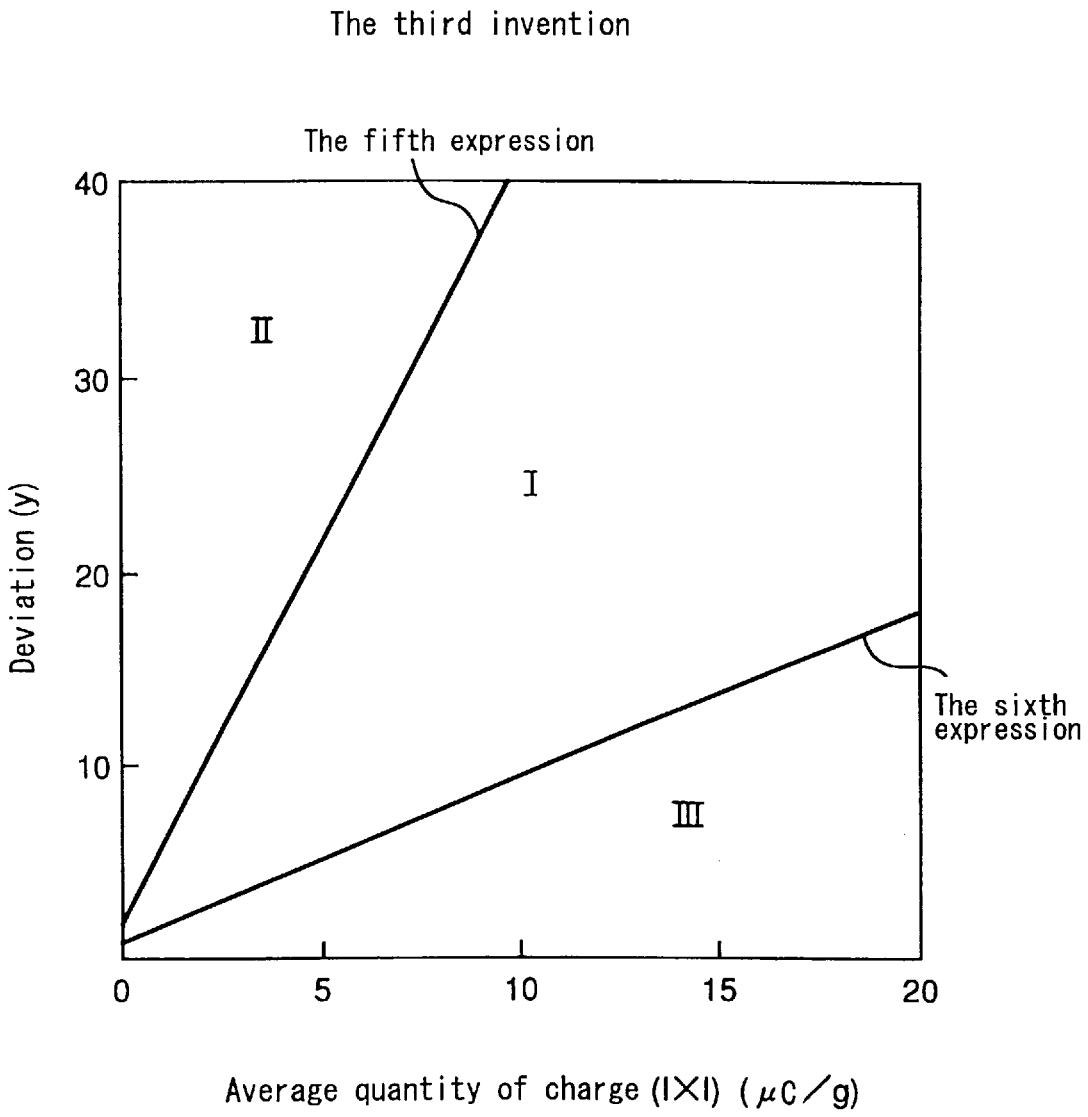
FIG. 3 is a conceptual drawing that shows expressions of the third invention.

Although the toner quantity of charge is dependent on charging conditions such as a blade pressure, an applied voltage, a blade material and a sleeve material, the toner of the third invention is only required to satisfy the above-mentioned expressions on a toner layer formed on a toner-supporting member. In other words, the toner of the third invention is only required to satisfy the above-mentioned expressions on the toner supporting-member at the time of jetting the toner from the toner-supporting member to the recording medium, and also is only required to have the average degree of roundness in the above-mentioned range. More specifically, in the case when the average degree of roundness is set in the above-mentioned range, as illustrated in FIG. 3, the toner of the third invention has its (|x|, y) (x: average quantity of charge ($\mu$C/g), y: distribution deviation of quantity of charge) set within area I on the toner-supporting member. Area I indicates an area surrounded by a solid line based upon the above-mentioned expressions. In the same manner as the first invention, |x| refers to an absolute value of the average quantity of charge (x), x may be either a positive or negative value. Moreover, FIG. 3 shows a case in which |x| is set in the range of 0 to 20 $\mu$C/g; however, it is not limited by this range as long as it satisfies the above-mentioned expressions.

When the toner does not satisfy the fifth expression, that is, when its (|x|, y) is located within area II in FIG. 3, problems of tailing and FPC stain arise. It is considered that when the toner is in area II, the quantity of charge of the toner has relatively greater variations, causing a delay in flying response in toner particles having relatively small quantity of charge, and the subsequent tailing. Moreover, when the toner quantity of charge has great variations, oppositely charged toner particles and toner particles having extremely high quantity of charge are more likely to be generated; consequently, these toner particles adhere to recording electrodes (FPC stain), resulting in problems such as clogging.

When the toner does not satisfy the sixth expression, that is, when its (|x|, y) is located within area III in FIG. 3, problems with the toner particle converging property and separating property arise. Since the toner located within area III has a relatively small distribution deviation of quantity of charge, there is an extreme increase in the repulsive force between toner particles at the time of flying, resulting in the problem with the convergence. Moreover, since toner particles separated from the toner supporting-member have a smaller deviation in the distribution of quantity of charge and since their flying response is virtually the same, the individual toner particle flows into holes in the same manner, thereby causing a high probability of clogging. Furthermore, in the case when the distribution deviation of quantity of charge is relatively small, the adhesive force of toner particles to the supporting-member becomes greater uniformly when the toner average quantity of charge is relatively great; therefore, it becomes more difficult to separate the toner from the supporting member, causing the problem with the separation property, and the subsequent reduction in density.

With respect to the toner used in measurements on the average quantity of charge and distribution deviation of quantity of charge as well as the measuring method, the toners which are the same as the first invention are used. Here, the device setting conditions are explained as follows:

GASS SUPPLY: 0.05 to 0.3 kgf/cm$^2$

AIR FLOW: −0.03

FEED CONDITION

INTERVAL: 10 to 19 sec

PULSE DURATION: 1 sec.

RUNNING TIME: 450 m

PM VOLTAGE: 5.35 kV

Therefore, even if any device and any conditions are used as the printing apparatus and setting conditions to which any toner is applied, the average quantity of charge and the distribution deviation of quantity of charge of the toner (toner layer) on the toner supporting-member that is formed on an actual printing apparatus under actual setting conditions to which the toner is applied satisfy the above-mentioned expressions and if the average degree of roundness, which will be described later, is located within the specified range, the toner is included within the range of the third invention.

In the third invention, the preferably ranges of |x| and y are the same as those ranges in the first invention.

In the third invention, when the average degree of roundness is located out of the above-mentioned range, 0.954 to 0.992, area I in which (|x|, y) of the toner is allowed to exist is narrowed. More specifically, it becomes the same as area I in the first invention.

In the present specification, the average degree of roundness is an average value calculated from the following equation:

Average degree of roundness=Peripheral length of a circle equal to projection area of a particle/Peripheral length of a particle projection image, where "Peripheral length of a circle equal to projection area of a particle" and "Peripheral length of a particle projection image" are represented by values obtained through measurements carried out by using a flow-type particle image analyzer (FPIA-1000 or FPIA-2000; made by Toa Iyoudenshi K.K.) in an aqueous dispersion system. Here, in the present invention, the average degree of roundness is not necessarily measured by the above-mentioned device; and the measurements may be carried out by any device as long as the values are obtained based upon the above-mentioned expressions in principle.

Moreover, in the third invention, the aforementioned "ratio of content of toner having a particle size of not less than 9 $\mu$m" is not particularly limited. The toner volume-average particle size (hereinafter, referred to simply as the average particle size) ($D_{50}$) is not particularly limited, and this is determined, taking into consideration systematically factors such as the prevention of clogging, control of the average quantity of charge and improvements in printed image quality. In general, the average particle size is set to not more than 10 $\mu$m, and more preferably, not more than 8 $\mu$m; and the smaller this is, the more preferable.

As described above, the toner of the third invention may be manufactured by using any method as long as the average degree of roundness is located within the desired range, and as long as the average quantity of charge and the distribution deviation of quantity of charge satisfy the above-mentioned expressions.

For example, in the third toner, toner particles may be obtained in the same manufacturing method as the first toner, and the third toner may be obtained by subjecting these to a surface treatment by using a surface-modifying device.

Examples of the surface-modifying devices used for controlling the average degree of roundness include: surface-modifying devices using the high-speed gas-flow impact method, such as Hybridization System (made by Narakikai Seisakusho K.K.), a Cosmos System (made by Kawasaki Jyukogyo K.K.), an Inomizer System (made by Hosokawa Micron K.K.), and a Turbomill (made by Turbo Kogyo K.K.), those devices using the dry mechanochemical method, such as a Mechanofusion System (made by Hosokawa Micron K.K.) and a Mechanomill (made by Okadaseikou K.K.), those devices using the gas-flow modifying method, such as a Surfusing System (made by Nippon Pneumatic MFG.) and a heat treatment device (made by Hosokawa Micron K.K.) and those devices in which the wet coating method is applied, such as a Dispacoat (made by Nisshin Engineering K.K.) and Coatmizer (made by Freund Sangyo K.K.).

Figure 10:
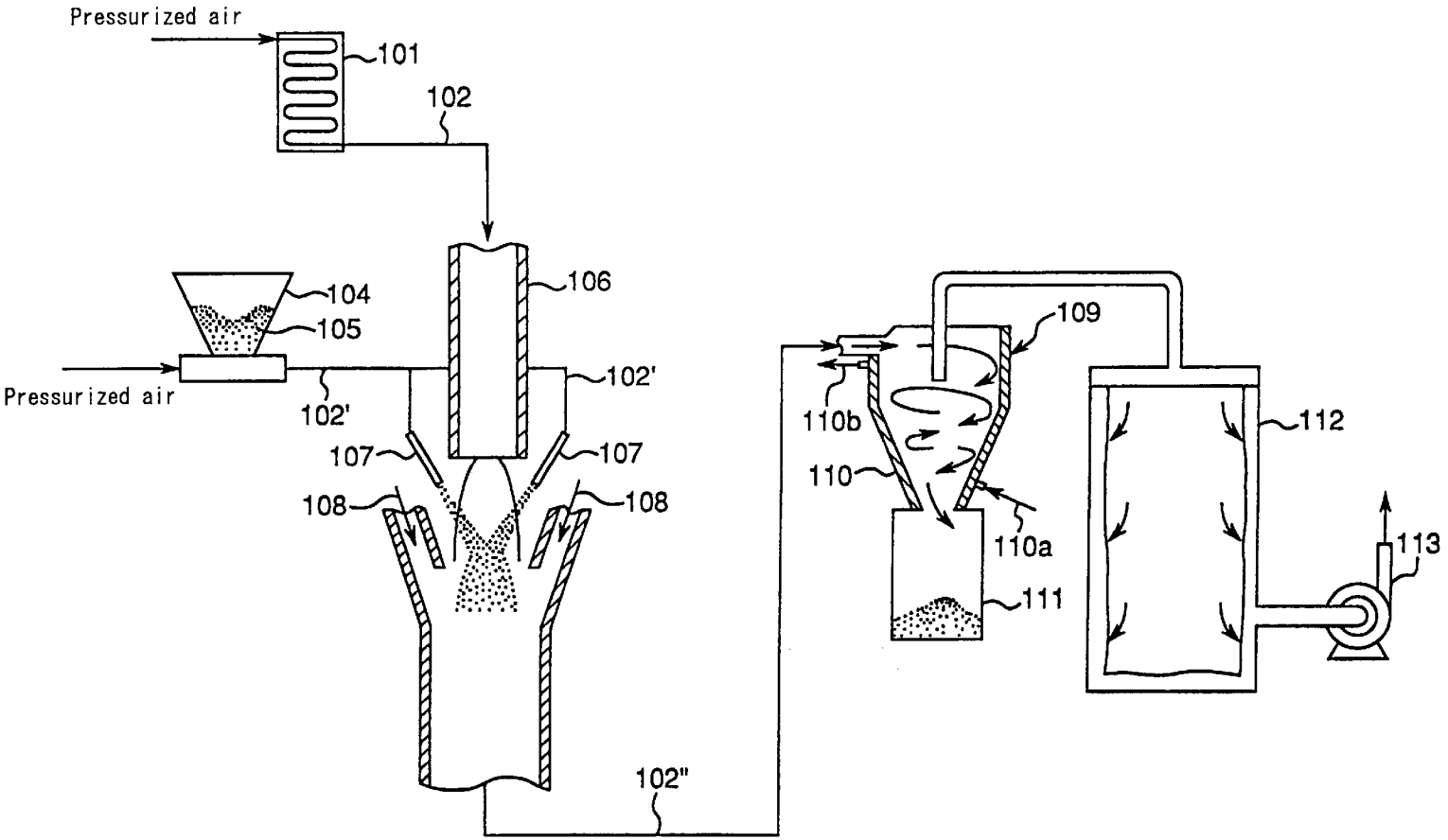
FIG. 10 is a schematic view showing a toner surface-modifying device.

Among the above-mentioned surface-modifying devices, it is most preferable to use the Surfusing System (made by Nippon Pneumatic MFG.), it can control the degree of roundness greatly in achieving the objective of the present invention. Referring to FIG. 10, an explanation will be given of the operation of this system. As illustrated in FIG. 10, high-temperature, high-pressure air (hot air), formed in a hot-air generating device 101, is discharged by a hot-air discharging nozzle 106 through a directing tube 102. Toner particles (sample) 105 to be subjected to the surface-modifying treatment are carried by a predetermined amount of pressurized air from a fixed amount supplying device 104 through a directing tube 102', and discharged into the hot air by sample-discharging nozzles 107 installed around the hot-air discharging nozzle 106. Here, it is preferable to provide a predetermined tilt to the sample-discharging nozzles 107 with respect to the hot-air discharging nozzle 106 so as not to allow the discharging flow from each sample-discharging nozzle 107 to cross the hot air flow. The toner particles, thus discharged, are allowed to contact the high-temperature hot air instantaneously, and subjected to a surface-modifying treatment uniformly.

Next, the toner particles, which have been subjected to a surface-modifying treatment, are immediately cooled off by a cold air flow directed from a cooling-air directing section 108. Such an immediate cooling process makes it possible to prevent adhesion of the toner particles to the device walls and aggregation of the toner particles, and consequently to improve the yield. Next, the toner particles are collected into a cyclone 109 through the directing tube 102", and then stored in a production tank 111. The carrier air from which the toner particles have been removed is allowed to pass through a bug filter 112 by which file powder is removed therefrom, and released into the air through a blower 113. Here, the cyclone 109 is provided with a cooling jacket 110 through which cooling water (110*a* and 110*b*) runs, so as to cool the toner particles inside the cyclone by the cooling water and to prevent aggregation thereof.

In the case when a surface-modifying treatment is carried out so as to control the average degree of roundness of toner particles as described above, it is preferable to add a post-treatment agent prior to the treatment. This makes it possible to improve the dispersing property of the toner particles at the time of the treatment, and to reduce variations in their shape. The amount of addition is preferably set in the range of 0.1 to 5% by weight with respect to the toner particles. With respect to the post-treatment agent added in this case, the aforementioned post-treatment agents that are to be added so as to control the average quantity of charge may be used.

In the case when the surface-modifying treatment is carried out by using the above-mentioned device, the toner average degree of roundness can be easily controlled by finely adjusting the device conditions, such as, for example, the process highest temperature, residence time, powder dispersion density, cooling-air temperature and cooling-water temperature.

With respect to the control methods for the average quantity of charge and distribution deviation of quantity of charge of the third toner, the same methods as in the toner of the first invention may be adopted.

With respect to the toner components constituting the third toner, for example, a binder resin, a colorant, wax and a charge control agent, the same components as in the first toner may be used.

The toner of the fourth invention is designed so that the ratio of content of toner particles having a particle size of not less than 9 $\mu$m is not more than 20% by weight, the average degree of roundness of toner is set in the range of 0.954 to 0.992 and the relationship between the average quantity of charge (x) and the distribution deviation of quantity of charge (y) satisfies the following expressions:

$$y \leqq 4.17|x| + 2.68 \quad \text{(seventh expression)}$$

$$y \geqq 0.68|x| + 1.13 \quad \text{(eighth expresssion).}$$

Figure 4:
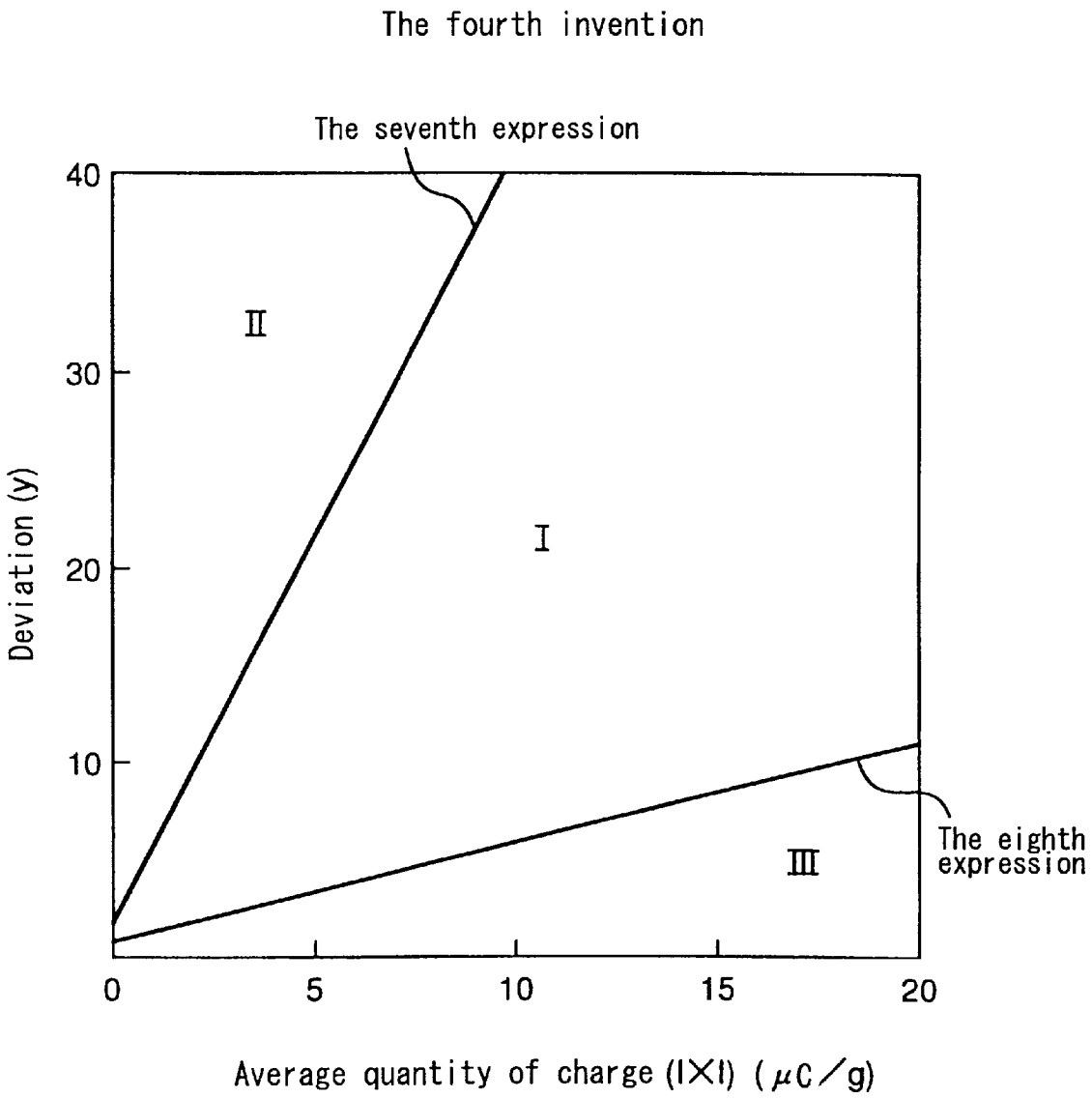
FIG. 4 is a conceptual drawing that shows expressions of the fourth invention.

Although the toner quantity of charge is dependent on charging conditions such as a blade pressure, an applied voltage, a blade material and a sleeve material, the toner of the fourth invention is only required to satisfy the above-mentioned expressions on a toner layer formed on a toner-supporting member. In other words, the toner of the fourth invention is only required to satisfy the above-mentioned expressions on the toner-supporting member at the time of jetting the toner from the toner-supporting member to the recording medium, and also is only required to have the ratio of content of toner particles having a particle size of not less than 9 $\mu$m and the average degree of roundness set in the above-mentioned ranges respectively. More specifically, in the case when the ratio of content of toner particles having a particle size of not less than 9 $\mu$m and the average degree of roundness are in the above-mentioned ranges respectively, as illustrated in FIG. 4, the toner of the fourth invention has its (|x|, y) (x: average quantity of charge ($\mu$C/g), y: distribution deviation of quantity of charge) set within area I on the toner supporting-member. Area I indicates an area surrounded by a solid line based upon the above-mentioned expressions. In the same manner as the first invention, |x| refers to an absolute value of the average quantity of charge (x), x may be either a positive or negative value. Moreover, FIG. 4 shows a case in which |x| is set in the range of 0 to 20 $\mu$C/g; however, it is not limited by this range as long as it satisfies the above-mentioned expressions.

When the toner does not satisfy the seventh expression, that is, when its (|x|, y) is located within area II in FIG. 4, problems of tailing and FPC stain arise. It is considered that when the toner is in area II, the quantity of charge of the toner has relatively greater variations, causing a delay in flying response in toner particles having relatively small quantity of charge, and the subsequent tailing. Moreover, when the toner quantity of charge has great variations, oppositely charged toner particles and toner particles having extremely high quantity of charge are more likely to be generated; consequently, these toner particles adhere to recording electrodes (FPC stain), resulting in problems such as clogging.

When the toner does not satisfy the eighth expressions, that is, when its (|x|, y) is located within area III in FIG. 4, problems with the toner particle converging property and separating property arise. Since the toner located within area III has a relatively small distribution deviation of quantity of charge, there is an extreme increase in the repulsive force between toner particles at the time of flying, resulting in the problem with the convergence. Moreover, since toner particles separated from the toner supporting-member have a smaller deviation in the distribution of quantity of charge and since their flying response is virtually the same, the individual toner particles flow into holes in the same manner, thereby causing a high probability of clogging. Furthermore, in the case when the distribution deviation of quantity of charge is relatively small, the adhesive force of toner particles to the supporting member becomes greater uniformly when the toner average quantity of charge is relatively great; therefore, it becomes more difficult to separate the toner from the supporting member, causing the problem with the separation property, and the subsequent reduction in density.

With respect to the toner used in measurements on the average quantity of charge and distribution deviation of quantity of charge as well as the measuring method, those which are the same as the first invention are used. Here, the device setting conditions are the same as in the third invention.

Therefore, even if any device and any conditions are used as the printing apparatus and setting conditions to which any toner is applied, the average quantity of charge and the distribution deviation of quantity of charge of the toner (toner layer) on the toner-supporting member that is formed on an actual printing apparatus under actual setting conditions to which the toner is applied satisfy the above-mentioned expressions and if the ratio of content of toner particles having a particle size of not less than 9 μm and the average degree of roundness are located within the specified ranges, the toner is included within the range of the fourth invention.

In the fourth invention, the preferably ranges of |x| and y are the same as those ranges in the first invention.

In the fourth invention, when the ratio of content of toner particles having a particle size of not less than 9 μm exceeds 20% by weight and when the average degree of roundness is out of the above-mentioned range, 0.954 to 0.992, area I in which (|x|, y) of the toner is allowed to exist is narrowed. More specifically, when the ratio of content of toner particles having a particle size of not less than 9 μm is solely out of the specified range, area I in which (|x|, y) of the toner is allowed to exist becomes the same as area I in the third invention, and when the average degree of roundness is solely out of the specified range, area I in which (|x|, y) of the toner is allowed to exist becomes the same as area I in the second invention. Moreover, when both of the ratio of content of toner particles having a particle size of not less than 9 μm and the average degree of roundness are out of the specified ranges, area I in which (|x|, y) of the toner is allowed to exist becomes the same as area I in the first invention.

With respect to the measuring methods for the ratio of content of toner particles having a particle size of not less than 9 μm and the toner average degree of roundness, the same measuring methods as in the toners of the second and third inventions are used.

Moreover, in the fourth invention, the toner volume-average particle size (hereinafter, referred to simply as the average particle size) ($D_{50}$) is not particularly limited, and this is determined, taking into consideration systematically factors such as the prevention of clogging, control of the average quantity of charge and improvements in printed image quality. In general, the average particle size is set to not more than 10 μm, and more preferably, not more than 8 μm; and the smaller this is, the more preferable.

As described above, the toner of the fourth invention may be manufactured by using any method as long as the ratio of content of toner particles having a particle size of not less than 9 μm and the average degree of roundness are located within the desired range, and as long as the average quantity of charge and the distribution deviation of quantity of charge satisfy the above-mentioned expressions.

For example, in the fourth toner, toner particles may be obtained in the same manufacturing method as the second toner, and the fourth toner may be obtained by subjecting these to a surface-modifying treatment by using the same manufacturing method as in the third toner.

With respect to the control methods for the toner average quantity of charge and the distribution deviation of quantity of charge of the fourth toner, the same methods as in the toner of the first invention may be used. With respect to the control method for the ratio of content of toner particles having a particle size of not less than 9 μm, the same methods as in the toner of the second invention may be used. With respect to the control method for the average degree of roundness, the same methods as in the toner of the third invention may be adopted.

With respect to the toner components constituting the fourth toner, for example, a binder resin, a colorant, wax and a charge control agent, the same components as in the first toner may be used.

In the first method of use of a toner for toner-jetting, the toner for toner-jetting is charged in a such manner that the toner average quantity of charge (x) and the distribution deviation of quantity of charge (y) satisfy the aforementioned expression 1 and expression 2. The application of such toner that has been charged in such a manner that the expressions of the first invention are satisfied makes it possible to provide images having superior image quality without causing any clogging, tailing or a reduction in the density.

In the first method, the toner only needs to be charged in such a manner that the first expression and second expression are satisfied in a toner-jetting system. More specifically, the toner is charged in a manner so as to satisfy the first expression and second expression on the toner-supporting member. With respect to the printing apparatus and its setting conditions used, any apparatus and conditions may be used as long as the printing apparatus uses a toner-jetting system.

The relationship of the above-mentioned expressions is shown in the same Figure as FIG. 1. The explanation given in the case when the first and second expressions are not satisfied, the explanations of the average quantity of charge and the distribution deviation of quantity of charge, measuring methods of these, desired ranges and control methods are the same as those in the first invention.

In the first method, any known toner in the field of toner-jetting may be used as the toner, and the toner is obtained by using the same toner components and method as the toner of the first invention. Here, the toner of the first invention is preferably used.

In the second method of use of a toner for toner-jetting, the toner for toner-jetting, which has its ratio of content of toner particles having not less than a particle size of 9 μm set to not more than 20% by weight, is charged in a such manner that the toner average quantity of charge (x) and the distribution deviation of quantity of charge (y) satisfy the aforementioned expression 3 and expression 4. The application of such toner that has been charged in such a manner that the expressions of the second invention are satisfied makes it possible to provide images having superior image quality without causing any clogging, tailing or a reduction in the density.

In the second method, the toner, which has its ratio of content of toner particles having not less than a particle size of 9 μm set not more than 20% by weight, only needs to be charged in such a manner that the third expression and fourth expression are satisfied in a toner-jetting system. More specifically, the toner is charged in a manner so as to satisfy the third expression and fourth expression on the toner-supporting member. With respect to the printing apparatus and its setting conditions used, any apparatus and conditions may be used as long as the printing apparatus uses a toner-jetting system.

The relationship of the above-mentioned expressions is shown in the same Figure as FIG. 2. The explanation given in the case when the third and fourth expressions are not satisfied, the explanations of the ratio of content of toner particles having not less than a particle size of 9 μm the average quantity of charge and the distribution deviation of quantity of charge, measuring methods of these, desired ranges and control methods are the same as those in the second invention.

In the second method, any known toner in the field of toner-jetting may be used as long as the toner ratio of content of toner particles having not less than a particle size of 9 μm is set to not more than 20% by weight, and the toner is obtained by using the same toner components and method as the toner of the second invention. Here, the toner of the second invention is preferably used.

In the third method of use of a toner for toner-jetting, the toner used for toner-jetting, which has its average degree of roundness in the range of 0.954 to 0.992, is charged in a such manner that the toner average quantity of charge (x) and the distribution deviation of quantity of charge (y) satisfy the aforementioned expression 5 and expression 6. The application of such toner that has been charged in such a manner that the expressions of the third invention are satisfied makes it possible to provide images having superior image quality without causing any clogging, tailing or a reduction in the density.

In the third method, the toner, which has its average degree of roundness in the range of 0.954 to 0.992, only needs to be charged in such a manner that the fifth expression and sixth expression are satisfied in a toner-jetting system. More specifically, the toner is charged in a manner so as to satisfy the fifth expression and sixth expression on the toner-supporting member. With respect to the printing apparatus and its setting conditions used, any apparatus and conditions may be used as long as the printing apparatus uses a toner-jetting system.

The relationship of the above-mentioned expressions is shown in the same Figure as FIG. 3. The explanation given in the case when the fifth and sixth expressions are not satisfied, the explanations of the average degree of roundness, the average quantity of charge and the distribution deviation of quantity of charge, measuring methods of these, desired ranges and control methods are the same as those in the third invention.

In the third method, any known toner in the field of toner-jetting may be used as long as the average degree of roundness is set in the range of 0.954 to 0.992, and the toner is obtained by using the same toner components and method as the toner of the third invention. Here, the toner of the third invention is preferably used.

In the fourth method of use of a toner for toner-jetting, the toner for toner-jetting, which has its ratio of content of toner particles having not less than a particle size of 9 μm set to not more than 20% by weight and which has its average degree of roundness set in the range of 0.954 to 0.992, is charged in a such manner that the toner average quantity of charge (x) and the distribution deviation of quantity of charge (y) satisfy the aforementioned expression 7 and expression 8. The application of such toner that has been charged in such a manner that the expressions of the fourth invention are satisfied makes it possible to provide images having superior image quality without causing any clogging, tailing or a reduction in the density.

In the fourth method, the toner, which has its ratio of content of toner particles having not less than a particle size of 9 μm set to not more than 20% by weight and which has its average degree of roundness set in the range of 0.954 to 0.992, only needs to be charged in such a manner that the seventh expression and eighth expression are satisfied in a toner-jetting system. More specifically, the toner is charged in a manner so as to satisfy the seventh expression and eighth expression on the toner-supporting member. With respect to the printing apparatus and its setting conditions used, any apparatus and conditions may be used as long as the printing apparatus uses a toner-jetting system.

The relationship of the above-mentioned expressions is shown in the same Figure as FIG. 4. The explanation given in the case when the seventh and eighth expressions are not satisfied, the explanations of the ratio of content of toner particles having not less than a particle size of 9 μm, the average degree of roundness, the average quantity of charge and the distribution deviation of quantity of charge, measuring methods of these, desired ranges and control methods are the same as those in the fourth invention.

In the fourth method, any known toner in the field of toner-jetting may be used, as long as the ratio of content of toner particles having not less than a particle size of 9 μm is set to not more than 20% by weight and as long as the average degree of roundness is set in the range of 0.954 to 0.992, and the toner is obtained by using the same toner components and method as the toner of the fourth invention. Here, the toner of the fourth invention is preferably used.

The above-mentioned toners of the first to fourth inventions and the first to fourth methods are preferably applied to an apparatus using a toner-jetting system in which toner is jettingly adhered to a recording medium. More specifically, in the toner-jetting system (direct recording method), a recording electrode and a back electrode are placed face to face with a toner-supporting member (intermediate roller), and a recording medium such as paper is transported between the recording electrode and the back electrode, while a voltage corresponding to an image signal is applied to the recording electrode so that an electrostatic force is exerted on the toner. Thus, the toner is jettingly adhered to the recording medium from the toner-supporting member in accordance with an applied state of the voltages. Referring to Figures, the following description will discuss the image-forming apparatus (direct printing apparatus) using the above-mentioned toner-jetting system in detail.

Figure 5:
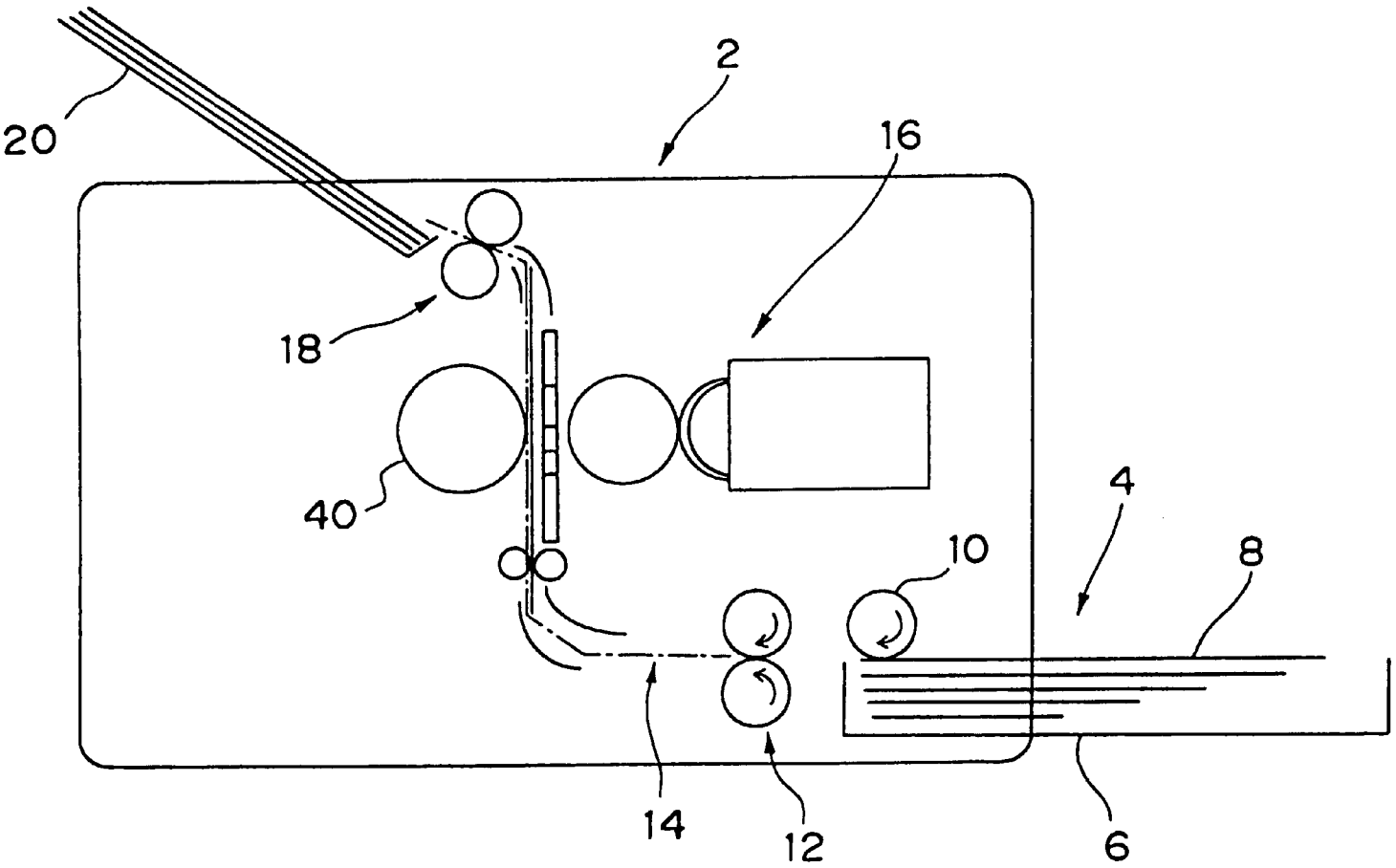
FIG. 5 is a schematic view showing one example of a direct printing apparatus to which the toner of the present invention is applied.

FIG. 5 shows an image-forming apparatus (a direct printing apparatus), indicated by reference numeral 2 in its entire layout, to which the toner or the method of the present invention is applicable. The printing apparatus 2 has a sheet supplying station whose entire layout is indicated by reference numeral 4. The sheet-supplying station 4 has a cassette 6 in which sheets 8 such as paper are stacked and housed. A sheet-supplying roller 10, placed on the cassette 6, is allowed to rotate while contacting the uppermost sheet 8 so that the sheet 8 is fed into the printing apparatus 2. In the vicinity of the sheet-supplying roller 10, a pair of timing rollers 12 are placed so that the sheet 8, fed from the cassette 6, is supplied along a sheet path 14 indicated by a dash line to a printing station (whose entire layout is indicated by reference numeral 16) for forming an image made of a printing material on the sheet 8. The printing apparatus 2 is also provided with a back roller 40 that is placed face to face with the printing station 16 so as to direct the flied toner particles. The printing apparatus 2 is further provided with a fixing station 18 for permanently fixing the image made of the printing material on the sheet 8, and a final stacking station 20 for housing the sheet 8 on which the image made of the printing material has been fixed.

FIG. 6 is a schematic drawing showing structures of the printing station 16 and the back roller 40. The printing station 16 is provided with a toner-supplying device whose entire layout is indicated by reference numeral 24, which is placed on the sheet path 14. The toner-supplying device 24 has a container 26 having an opening 28 that faces the sheet path 14. In the vicinity of the opening 28, a toner-supplying roller 30 is supported so as to rotate in the direction of arrow 32. The toner-supplying roller 30 is made of a conductive material and electrically connected to a bias power supply 34 that is a dc power supply. A blade 36, which is made of a plate preferably made from rubber or stainless steel, is placed in contact with a sleeve 63 externally attached to the toner-supplying roller 30.

The container 26 contains the printing material, that is, toner particles 38. The toner particles 38 are supplied to the sleeve 63 externally attached to the outer circumferential face of the toner-supplying roller 30 by an agitator 61 that is a supplying means installed in the container 26, and transported by the rotation of the toner-supplying roller 30. The agitator 61 is installed so as to be rotatable, and designed so as to shift the toner particles 38 stored in the container 26 toward the toner-supplying roller 30 by the rotation thereof, while preventing their blocking, etc. The toner-supplying roller 30 is formed by, for example, a material such as SK steel, aluminum and stainless steel, that is shaped into a cylinder, or it is formed by affixing a conductive elastic material (such as nitrile rubber, silicone rubber, styrene rubber, butadiene rubber, urethane rubber, etc.) on the outer circumference portion of a metal roller, and to this is applied a bias voltage (Vb) by the bias power supply 34.

The sleeve 63 has a cylinder shape having a circumferential length slightly longer than the outer circumferential length of the toner-supplying roller 30, and as illustrated in FIG. 6, this is externally attached to the toner-supplying roller 30. With respect to the sleeve 63, for example, either of the following sheets may be used: a soft resin sheet made from polycarbonate, nylon, fluororesin, etc., a sheet formed by adding carbon, whisker, or metal powder to any of these resins, a metal thin film made of nickel, stainless steel or aluminum, and a sheet formed by laminating the above-mentioned resin sheet and metal thin film.

The toner-supplying roller 30 having the sleeve 63 attached thereto is rotatably supported by a support shaft 30*a*, and connected to a driving source, not shown, so as to be driven to rotate in the direction of arrow 32 by the driving source, not shown. When the toner-supplying roller 30 rotates in the direction of arrow 32, the sleeve 63 is allowed to rotate following the toner-supplying roller 30, with the result that the outer face of the sleeve 63 covering a space section S slides on the surface of the intermediate roller 100 with an appropriate nip width. Moreover, the intermediate roller 100 is supported so as to rotate in the direction of arrow 101, connected to a driving source, not shown, and driven by the driving source, not shown, so as to rotate in the direction of arrow 101. The intermediate roller 100 is formed by metal, resin or rubber having a conductivity or a dielectric property, or a composite material there of, for example, a metal roller the surface of which is coated with a resin layer, etc. Moreover, the intermediate roller 100 is grounded in the present embodiment; however, an appropriate voltage may be applied thereto in accordance with image-forming conditions.

The blade 36 is attached to a portion of the container 26 opposite to the upper portion of the toner-supplying roller 30, and the blade 36 is pressed onto the toner-supplying roller 30 at its diagonally upper portion of the back face with the sleeve 63 interpolated in between. Here, with respect to the blade 36, a spring metal thin plate made of SK steel, stainless steel or phosphor bronze, or a plate made from fluororesin, nylon or rubber, or a composite board of these, for example, a stainless thin plate whose surface or tip portion is coated with rubber or resin, etc. may be used. A blade bias voltage (Vb1) is applied to the blade 36 by a blade bias power supply 62. The blade bias voltage (Vb1) has a predetermined potential difference from a bias voltage (Vb), and this potential difference is used for controlling the quantity of charge of the toner particles 38, and for shortening time required for the quantity of charge of the toner particles 38 to reach a necessary value in the initial stage wherein a toner layer is formed on the intermediate roller 100.

Moreover, to a portion of the container 26 opposite to a lower portion of the toner-supplying roller 30 is attached a lower seal member 60 formed by laminating a silicon rubber sheet on the surface of an elastic layer made of, for example, urethane foam, and this lower seal member 60 is allowed to contact the outer circumferential face of the toner-supplying roller 30 through the sleeve 63. A lower seal bias voltage (Vs) is applied to the lower seal member 60 by a lower seal bias power supply 64.

A printing head whose entire layout is indicated by reference numeral 50 is secured between the intermediate roller 100 and the sheet path 14 through which the sheet 8 is transported. The printing head 50 is made of a flexible printed circuit board (a partition wall) 52 having a thickness of approximately 100 to 200 $\mu$m; however, not limited by this, a circuit formed on a hard thin plate made of a material, such as ceramics, glass and resin, may be used.

A portion of the printing head 50, located on a printing area 54, is provided with a plurality of holes 56, each having an inner diameter of approximately 25 to 200 $\mu$m, which is virtually greater than the average particle size (approximately, several $\mu$m to several tens $\mu$m) of the toner particles 38. The greater the inner diameter of the hole, the better from the viewpoint of prevention of the toner particles from clogging; however, in contrast, from the viewpoint of high image quality, the smaller, the better. For this reason, the inner diameter of the hole is generally set in the range of 6 to 30 times the toner average particle size, and more preferably, 10 to 20 times. These holes 56 are formed with equal intervals along one line parallel to the shaft of the toner-supplying roller 30. Alternatively, the holes 56 may be formed with equal intervals along a plurality of lines parallel to the shaft of the toner-supplying roller.

Moreover, the back roller, indicated by reference numeral 40 in its entire layout, is placed face to face with the printing head 50 with the sheet path 14 located in between. The back roller 40 is made of metal, such as SK steel, aluminum and stainless steel, a conductive material formed by coating the outer circumferential portion of a metal roller with an elastic material (such as nitrile rubber, silicone rubber, styrene rubber, butadiene rubber and urethane rubber), or a dielectric material such as dielectric resin, dielectric rubber. The back roller 40 is connected to a power supply 46 for supplying a back electrode voltage (Vbe) having a predetermined polarity thereto. In the printing area 54 at which the intermediate roller 100 faces the back electrode 40, the back electrode voltage (Vbe) electrically attracts charged toner particles 38 on the intermediate roller 100 toward the back roller 40. Here, the size and polarity of the electrical potential to be applied is preferably set depending on the characteristics of the toner to be used, printing conditions, environments, and other factors.

Referring to FIGS. 6 to 9, the following description will discuss the movement of toner particles in an initial stage of a formation of a toner layer.

While the toner-supplying roller 30 and the agitator 61 are being rotated by the driving source, not shown, the toner particles 38 inside the container 26 are forcefully transported toward the toner-supplying roller 30 by a stirring function of the agitator 61 (see FIG. 6). Here, the sleeve 63 is driven in the direction of arrow 32 by a frictional force against the toner-supplying roller 30, and the toner particles 38, kept in contact with the sleeve 63, is subjected to a transporting force in the direction of arrow 32 due to the contact against the sleeve 63 and an electrical force. Thus, the toner particles 38 are taken into an inlet section having a wedge shape formed by the sleeve 63 and the tip of the blade 36, and when they reach a press-contact portion against the blade 36, they are uniformly applied to the surface of the sleeve 63, and charged to a predetermined polarity. In the present embodiment, toner consisting of negatively chargeable toner particles 38 is used, and the explanation is given of the case in which the toner particles 38 are frictionally charged to a negative polarity; however, the present invention is not intended to be limited thereby. Consequently, the respective circumferential portions of the toner-supplying roller 30 having passed through the contact area between the developing roller 30 and the blade 36 comes to support a thin layer of the negatively charged toner particles 38. Moreover, as illustrated in FIG. 6, a bias voltage (Vb) is supplied to the toner-supplying roller 30 from the power supply 34 so that the negatively charged toner particles 38 are allowed to electrically adhere to the toner-supplying roller 30.

When the toner particles 38, held on the sleeve 63, are transported to an opposing portion to the intermediate roller 100 in accordance with the movement of the sleeve 63 that is driven by the toner-supplying roller 30, they are allowed to adhere to the surface of the intermediate roller 100 in accordance with the potential difference between bias voltages applied to the intermediate roller 100 and the toner-supplying roller 30. Here, the sleeve 63, which is in contact with the intermediate roller 100, is not in contact with the toner-supplying roller 30 with a space section S; therefore, the sleeve 63 is allowed to contact with the intermediate roller 100 softly in a uniform manner with an appropriate nip width, thereby making it possible to form a uniform toner layer on the intermediate roller 100. In this case, the layer thickness and the state of the layer of the toner layer formed on the intermediate roller 100 may be varied by providing a difference in velocity between the peripheral velocity of the intermediate roller 100 and the velocity of the sleeve 63 and oppositely setting the rotation direction of the intermediate roller 100 and the rotation direction of the sleeve 63.

In this manner, the layer of the toner particles 38 charged to a predetermined quantity of charge is formed on the intermediate roller 100 with a predetermined layer thickness, and transported in the rotation direction indicated by arrow 101, following the rotation of the intermediate roller 100. In the toner or the method of the present invention, the average quantity of charge and the distribution deviation of the quantity of charge of such toner (toner layer), formed on the intermediate roller 100 in this manner, are only required to satisfy specific expressions respectively.

The toner particles 38, having passed through the opposing portion against the intermediate roller 100, are continuously transported in the direction of arrow 32 together with the sleeve 63, and when they are passing through the gap to the lower seal member 60, a consumption pattern on the toner layer on the sleeve 63 is erased, and the above-mentioned operation is repeated thereafter.

FIG. 7 is an enlarged schematic view showing the vicinity of the printing area 54 shown in FIG. 6. The flexible printed circuit board 52 is provided with doughnut-shaped recording electrodes 58, each surrounding the corresponding holes 56 (see FIG. 8). In the present embodiment, the recording electrodes 58 are placed in succession in the circumferential direction; however, the present invention is not limited thereby, and the shape may be a horse shoe shape with one portion cut out or the like shape. As illustrated in FIG. 7, the recording electrodes 58 are placed on the side of the flexible printed circuit board 52 opposite to the intermediate roller 100. The recording electrodes 58 are connected to a printing signal output section 80, and the printing signal output section 80 is connected to an image-signal processing section (not shown); thus, based upon an image signal outputted from the image-signal processing section, the printing signal output section (a driver) 80 applies a printing signal to the recording electrodes 58. Reference numerals shown in FIG. 7 that are the same as those shown in FIG. 6 indicate the same members; therefore, an explanation thereof is omitted.

FIG. 9 shows one portion of a voltage waveform of the printing signal. In the present embodiment, the non-printing voltage 84 ($V_W$) is set to −70 V, and the printing voltage 86 ($V_B$) is set to +500 V.

For this reason, when only the non-printing voltage 84 ($V_W$) is applied to the recording electrodes 58, a group of negatively charged toner particles 38, located at a position opposite to the recording electrodes 58 on the intermediate roller 100, electrically repel the recording electrodes 58 to which the non-printing voltage 84 ($V_W$) has been applied, and reside on the intermediate roller 100. In contrast, when the printing voltage 86 ($V_B$) is applied to the recording electrodes 58, the group of negatively charged toner particles 38 are electrically attracted by the recording electrodes 58, and thereby activated, and allowed to fly from the intermediate roller 100 toward the holes 56 by an electric field between the intermediate roller and the back roller 44. The toner particles, thus allowed to fly and to pass through the holes 56, and electrically attracted (directed) toward the back electrodes 44, and are jettingly adhered to a sheet 8.

Here, in the above-mentioned apparatus, an explanation is given by exemplifying a case in which the intermediate roller is used as the toner supporting-member for supporting the toner particles before flying. However, the toner or the method of the present invention may be applied to another apparatus in which, without using the intermediate roller, toner particles are directly allowed to fly from the toner-supplying roller to a recording medium, that is, an apparatus in which the toner-supplying roller is used as the toner-supporting member. In this case, the toner-supplying roller may be or may not be provided with a sleeve.

The application of the first to fourth toners or the fifth to eighth methods of the present invention to such a direct-printing apparatus makes it possible to virtually prevent clogging in the holes of the recording electrodes, tailing and a reduction in the density, and consequently to provide superior images with high quality.

EXAMPLES

In the following examples, experimental examples 1 to 4 correspond to the first to fourth inventions.

Experimental Example 1

(Production example of polyester resin A)

To a four-neck glass flask provided with a thermometer, a stirrer, a dropping-type condenser and a nitrogen gas introducing tube were loaded polyoxypropylene(2,2)-2,2-bis(4-hydroxyphenyl)propane, polyoxyethylene (2,2)-2,2-bis(4-hydroxyphenyl)propane, isododecenyl succinic anhydride, terephthalic acid and fumaric acid (a weight ratio of these components was adjusted to 82:77:16:32:30), together with dibutyltin oxide as a polymerization initiator.

This mixture was allowed to react in a mantle heater while being stirred at 220° C. under a nitrogen gas atmosphere. A polyester resin A thus obtained had a softening point (Tm) of 110° C., a glass transition point (Tg) of 60° C. and an acid value of 17.5 KOH mg/g.

(Production example of polyester resin B)

Styrene and 2-ethylhexyl acrylate were mixed in a weight ratio of 17:3.2, and this mixture was loaded into a dropping funnel together with dicumyl peroxide as a polymerization initiator. To a four-neck glass flask provided with a thermometer, a stirrer, a dropping-type condenser and a nitrogen gas introducing tube were loaded polyoxypropylene(2,2)-2,2-bis(4-hydroxyphenyl)propane, polyoxyethylene(2,2)-2,2-bis (4-hydroxyphenyl) propane, isododecenyl succinic anhydride, terephthalic acid, 1,2,4-benzenetricarboxylic anhydride and acrylic acid (a weight ratio of these components was adjusted to 42:11:11:11:8:1), together with dibutyltin oxide as a polymerization initiator. This mixture was stirred at 135° C. in a mantle heater under a nitrogen gas atmosphere, with styrene, etc. being dropped therein from the dropping funnel, and then the obtained mixture was heated to 230° C. at which reaction was carried out. A polyester resin B thus obtained had a softening point of 150° C., a glass transition point of 62° C. and an acid value of 24.5 KOH mg/g.

(Production example of polyester resin C)

A four-neck glass flask (5 liters) provided with a reflux condenser, a water separator, an $N_2$ gas introducing tube and a stirrer was placed in a mantle heater. To this flask were loaded 1376 g of a bisphenol-propylene oxide adduct and 443 g of isophthalic acid, and this mixture was subjected to a polycondensation reaction accompanied with a dehydration at 220 to 270° C. while introducing $N_2$ gas into the flask, thereby obtaining a low-molecular-weight polyester resin (Mw; 4000, Tg; 58° C.).

On the other hand, a four-neck flask (5 liters) provided with a reflux condenser, a water separator, an $N_2$ gas introducing tube and a stirrer was placed in a mantle heater. To this flask were loaded 1720 g of a bisphenol-propylene oxide adduct, 1028 g of isophthalic acid, 328 g of 1,6-dipropyl-1,6-hexanediol and 74.6 g of glycerin, and this mixture was subjected to a polycondensation reaction accompanied with a dehydration at 240° C. while introducing $N_2$ gas into the flask, thereby obtaining a high-molecular-weight polyester resin (Mw; 6800, Tg; 38° C.).

The above-mentioned low-molecular-polyester resin (80 parts) and high-molecular-polyester resin (20 parts) were loaded into a Henschel Mixer, and subjected to a dry blending process so as to be sufficiently blended uniformly. Next, to this was loaded 40 parts of diphenylmethane-4,4-diisocyanate by using a heating kneader, and this mixture was allowed to react at 120° C. for one hour, thereby obtaining a urethane-modified polyester resin having a Tm of 110° C., a Tg of 59° C. and an acid value of 28 KOH mg/g. The urethane denatured polyester resin was referred to as polyester resin C.

(Production example of polyester resin D)

A four-neck flask (2 liters) provided with a reflux condenser, a water separator, a nitrogen gas introducing tube, a thermometer and a stirrer was placed in a mantle heater. To this flask were loaded polyoxypropylene(2,2)-2,2-bis(4-hydroxyphenyl)propane, polyoxyethylene (2,0)-2,2-bis(4-hydroxyphenyl)propane, fumaric acid and telephthalic acid (a mole ratio of these components was adjusted to 5:5:5:4), and this mixture was heated and stirred so as to react while introducing nitrogen gas into the flask. The progress of the reaction was monitored while measuring the acid value, and the reaction was stopped when the acid value had reached a predetermined value to obtain a polyester resin D having an Mn value of 4800, an Mw/Mn ratio of 4.0, a Tm of 100° C. and a Tg of 58° C.

(Production example of polyester resin E)

A four-neck flask (5 liters) provided with a reflux condenser, a water separator, an $N_2$ gas introducing tube, thermometer and a stirrer was placed in a mantle heater. To this flask were loaded 1376 g of a bisphenol-propylene oxide adduct and 472 g of isophthalic acid so as to have a COOH/OH ratio of 1.4, and this mixture was subjected to a polycondensation reaction accompanied with a dehydration at 240° C. while introducing $N_2$ gas into the flask, thereby obtaining a low-molecular-weight polyester e having a Mw of 5000 and a Tg of 61° C.

A four-neck flask (5 liters) provided with a reflux condenser, a water separator, an $N_2$ gas introducing tube, a thermometer and a stirrer was placed in a mantle heater. To this flask were loaded 1720 g of a bisphenol-propylene oxide adduct, 860 g of isophthalic acid, 119 g of succinic acid, 129 g of diethylene-glycol and 74.6 g of glycerin so as to have a OH/COOH ratio of 1.2, and this mixture was subjected to a polycondensation reaction accompanied with a dehydration at 240° C. while introducing $N_2$ gas into the flask, thereby obtaining a high-molecular-weight polyester e having a Mw of 7000 and a Tg of 42° C.

The above-mentioned low-molecular-polyester e (4200 parts by weight) and high-molecular-polyester e (2800 parts by weight) were loaded into a Henschel Mixer, and subjected to a dry blending process so as to be sufficiently blended uniformly. Next, to this mixture was added 100 parts by weight of diphenylmethane-4,4-diisocyanate in a heating kneader so as to have an NCO/OH ratio of 1.0, and this mixture was allowed to react at 120° C. for one hour, and after having confirmed that residual isolated isocyanate groups virtually disappeared based upon measurements on NCO%, this was cooled to obtain a polyester resin E having urethane bonds. This polyester resin E had a content of components which are insoluble in the solvent (methyl ethyl ketone) of 20% by weight, a glass transition point Tg of 65° C., a softening point Tm of 140° C. and an acid value of 25 KOH mg/g.

Experimental Example 1

(Toner 1-1)

The following components were sufficiently mixed by means of the Henschel mixer: polyester resin A (40 parts by weight), polyester resin B (60 parts by weight), polyethylene wax [800P; made by Mitsui Sekiyu Kagaku K.K.; melt viscosity 5400 cps; softening point 140° C. at 160° C.] (2 parts by weight), polypropylene wax [TS-200; made by Sanyo Kasei Kogyo K.K.; melt viscosity 120 cps; softening point 145° C.; acid value 3.5 KOHg/g at 160° C.] (2 parts by weight), acid carbon black [MOGUL L; made by Cabot Corporation; pH 2.5; average primary particle size of 24 nm] (8 parts by weight) and a negative charge control agent represented by following formula (1) (2 parts by weight). The obtained mixture were melt-kneaded by means of the twin screw extruder kneader. Then, this mixture was cooled off, coarsely pulverized by a hammer mill, and finely pulverized by a jet mill, and then classified; thus toner particles having a volume-average particle size of 7.85 μm was obtained.

(I)

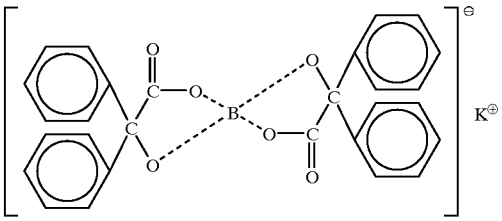

To these toner particles were added 0.8% by weight of hydrophobic silica (TS500; Cabozyl Corp.) and this blend was mixed for three minutes to obtain a toner.

(Toners 1-2 to 1-11)

Toners were obtained by using the same manufacturing method as that of the toner 1-1 with the exception of the followings. A binder resin, a wax, a colorant, a charge control agent, post-treatment agents and a conductivity-processing agent shown in Tables 1 and 2 were used by the respective amounts listed. The pulverizing conditions (including models, etc. of the pulverizer) and the classifying conditions (including models, etc. of the classifier) were altered appropriately. Here, with respect to the post-treatment agents and the conductivity-processing agent, titanium oxide, silica and the conductivity-processing agent were added and mixed in this order. The mixing time (titanium/silica/conductivity-processing agent) means the mixing time after the listed additives have been added in the order described in Table 1. For example, "5/3/3" indicates a five-minute mixing process after addition of titanium oxide, a three-minute mixing process after addition of silica and a three-minute mixing process after addition of the conductivity-processing agent.

TABLE 1

| Toner type | Binder resin (parts) | Wax (parts) | Colorant (parts) | Charge control agent (parts) |
|---|---|---|---|---|
| 1-1 | PESA (40) | 800P (2) | MOGUL L (8) | Formula (I) (2) |
| | PESB (60) | TS200 (2) | | |
| 1-2 | PESA (40) | 800P (2) | MOGUL L (8) | Formula (I) (2) |
| | PESB (60) | TS200 (2) | | |
| 1-3 | PESA (40) | 800P (2) | MOGUL L (8) | Formula (I) (2) |
| | PESB (60) | TS200 (2) | | |
| 1-4 | PESA (40) | 800P (2) | MOGUL L (8) | Formula (I) (2) |
| | PESB (60) | TS200 (2) | | |
| 1-5 | PESA (40) | 800P (2) | MOGUL L (8) | Formula (I) (2) |
| | PESB (60) | TS200 (2) | | |
| 1-6 | PESA (40) | 800P (2) | MOGUL L (8) | Formula (I) (2) |
| | PESB (60) | TS200 (2) | | |
| 1-7 | PESA (40) | 800P (2) | MOGUL L (8) | Formula (I) (2) |
| | PESB (60) | TS200 (2) | | |
| 1-8 | PESC (100) | Carnauba (1.5) | MOGUL L (5) | S-34 (2) |
| | | TS200 (1) | | |
| 1-9 | PESE (100) | TS200 (3) | MOGUL L (6) | S-34 (2) |
| 1-10 | PESE (100) | TS200 (3) | MOGUL L (6) | VP-434 (2) |
| 1-11* | PESD (100) | — | C.I. 184 (3) | E-84 (2) |

*Upon producing toner 1-11, a colorant was applied as a pigment master batch in combination with a binder resin.

TABLE 2

| | Post-treatment agent | | | | | | Mixing time |
|---|---|---|---|---|---|---|---|
| | Silica | | | Titanium oxide | | Conductivity-treatment agent | (titanium/silica/conductivity treatment agent) (min.) |
| Toner type | TS500 (weight %) | R972 (weight %) | NAX50 (weight %) | STT30A (weight %) | STT30A-FS10J (weight %) | Carbon XC72R | |
| 1-1 | 0.8 | — | — | — | — | — | 3 |
| 1-2 | 0.5 | — | — | 1 | — | — | 3/3 |
| 1-3 | 0.25 | — | 1 | 1 | — | — | 3/3 |
| 1-4 | — | — | 2 | 1 | — | — | 3/3 |
| 1-5 | 0.5 | — | — | — | 1 | — | 3/3 |
| 1-6 | 0.5 | — | — | 1 | — | 1 | 5/3/3 |
| 1-7 | 0.5 | — | — | 1 | — | — | 3/3 |
| 1-8 | 0.5 | — | — | 1 | — | — | 3/3 |
| 1-9 | 0.8 | — | — | — | — | — | 1.5 |
| 1-10 | 0.5 | — | — | 1 | — | — | 3/3 |
| 1-11 | 0.8 | — | — | — | — | — | 1.5 |

Here, in Tables 1 and 2, abbreviations are explained as follows:

With respect to binder resins, PESA represents polyester resin A; PESB, polyester resin B; PESC, polyester resin C; PESD, polyester resin D; and PESE, polyester resin E, respectively.

With respect to waxes, 800P represents polyethylene wax (800P; made by Mitsui Sekiyu Kagaku K.K.); TS200, polypropylene wax (TS-200; made by Sanyo Kasei Kogyo K.K.); and carnauba refers to carnauba wax (made by Kato Yoko K.K.).

With respect to colorants, MOGUL L represents acidic carbon black (MOGUL L; made by Cabot Corp.), and C.I.18 represents magenta pigment (C. I. Pigment Red 184).

The abbreviations of the charge control agents have the following meanings. Formula (I) represents a negative charge control agent represented-by the formula (I), S-34 represents S-34 (made by Orient Kagaku Kogyo K.K.), VP-434 represents a fluorine-containing quaternary ammonium salt (made by Crarient Corp.), and E-84 represents a zinc complex of salicylic acid (made by Orient Kagaku Kogyo K.K.).

The abbreviations of the post-treatment agents have the following meanings. R972 represents hydrophobic silica (R972; made by Nippon Aerosil K.K.), NAX50 represents hydrophobic silica (NAX50; made by Nippon Aerosil K.K.), TS500 represents hydrophobic silica (TS-500; made by Cabozyl Corp.), STT30A represents titanium oxide (STT-30A; made by Titan Kogyo K.K.), and STT30A-FS10J represents titanium oxide (STT-30A-FS10J; made by Titan Kogyo K.K.).

With respect to conductivity-treatment agents, Carbon XC72R represents XC72R (made by Cabot Corp.).

Here, upon manufacturing toner 1-11, a colorant is used in combination with a binder resin to be used, as a pigment master batch. The pigment master batch was obtained by the following process: A binder resin accounting for 7 parts by weight (wherein the ratio of mixture weight is the same as the weight ratio of the mixed binder resin to be used) of a total of 100 parts by weight was fused and kneaded with 3 parts by weight of a colorant, and after having been cooled, this was pulverized. In other words, in the manufacturing process of the toner particles in the toner 11, 93 parts by weight of the binder resin, 10 parts by weight of the pigment master batch, and the above-mentioned amount of wax and a charge control agent were used.

The obtained toner was measured by means of a Coulter Counter Multisizer (made by COULTER Corp.) on its average particle size ($D_{50}$).

With respect to the charging properties (average quantity of charge, deviation), FPC stain, tailing, converging property and separating property, evaluation was made on the resulting toner. Here, the evaluation was made when the blade pressure was set at 6 g/mm and 4 g/mm.

(Average quantity of charge), (Deviation)

With respect to the average quantity of charge and distribution deviation of quantity of charge of the toner, a toner layer, formed on the intermediate roller 100 by the printing apparatus of FIG. 6, was collected, and this was measured by an E-spart analyzer (E-SPART-2; made by Hosokawa Micron K.K.). Here, the setting conditions of the printing apparatus were the same as those used for evaluation on the FPC stain which will be described later. Moreover, the setting conditions of the measuring device were the same as those used in the explanation of the toner of the first invention.

(FPC stain)

Toner was loaded in the printing apparatus having the arrangement shown in FIG. 6 and a black solid image was printed once using a sheet of paper of A-4, and at this time, the aperture ratio of the holes was evaluated. More specifically, an image of the holes was taken by a magnification of 175 times from the intermediate roller side, and when no holes have an aperture ratio of less than 60%, this case was evaluated as "○"; and when one or more holes have an aperture ratio of less than 60%, this case was evaluation as "X". The aperture ratio is represented by "the aperture diameter of a hole after printing/the aperture diameter of the hole before printing". In the case of the hole having an aperture ratio of less than 60%, when the above-mentioned printing processes are carried out 5 times, it is highly possible that any detective print appears in the course of the processes.

The setting conditions of the printing apparatus at this time are shown as follows (Abbreviation symbols; see FIGS. 6, 7 and 9)

Mechanical setting: Lk; 90 μm, Li; 200 μm

Electrical setting: Recording electrode potential ($V_B$ (ON time); +500 V, $V_W$ (OFF time): −70 V), Back roller potential (Vbe); 1000 V, Supply roller potential (Intermediate roller potential); 0 V, Vb; −15 V, Vs=Vb, Vbl; Vb −200 V Intermediate roller amount of adhesion: approximately 0.8 mg/cm$^2$ Respective roller velocities: Sleeve peripheral velocity; 79.8 mm/s, Intermediate roller peripheral velocity; 202.6 mm/s, Back roller peripheral velocity (Paper feeding speed); 104.2 mm/s FPC used; 4 row, 300 dpi (thickness 110 μm, diameter of hole 140 μm)

(Tailing)

Toners were loaded in the printing apparatus having the arrangement shown in FIG. 6, dot printing processes were carried out, the printed images were observed visually under a loupe (175 magnifications), and the evaluation was made based on the aspect ratio. When the aspect ratio was not more than 1.2, this case was evaluated as "○"; and when the aspect ratio was above 1.2, this case was evaluation as "X". The aspect ratio is represented by "longitudinal line (1 dot) width/lateral line (1 dot) width". Tailing refers to a phenomenon in which dots are extended and distorted in the paper-transporting direction (in the longitudinal direction in this case). The setting conditions of the printing apparatus were the same as those used in the evaluation on the FPC stain.

(Converging property)

Lines were printed on normal paper under the same setting conditions as the printing apparatus used in the evaluation on FPC stain, except that the dot pitch was set to 115 μm (approximately 221 dpi). In this case, the fixing process after the image formation was carried out by a hot plate of the non-contact type. An enlarged drawing (×175) of the resulting image was digitized by a digital-microscope (VF-6300; made by Kience Corp.), and after the digital image had been subjected to a shading correction (angle correction), this was measured so as to obtain the luminance profile of lines (Image processing software; Image Pro Plus). Next, the luminance profile was approximated by using a Gauss function, the "max-min" of the luminance, that is, the half-value width of the Gauss function was calculated, and ranking values were obtained in accordance with an equation described below. When the ranking value was not less than 4, this case was evaluated as "○"; and when the ranking value was less than 4, this case was evaluation as "X". Here, in the case when the luminance in the center of the profile was saturated because the dots overlapped portion was large, only the edge portion was extracted, approximated and evaluated.

Ranking value=6 log ("max-min" of luminance/half-value width of Gauss function)+3.885

Figure 11:
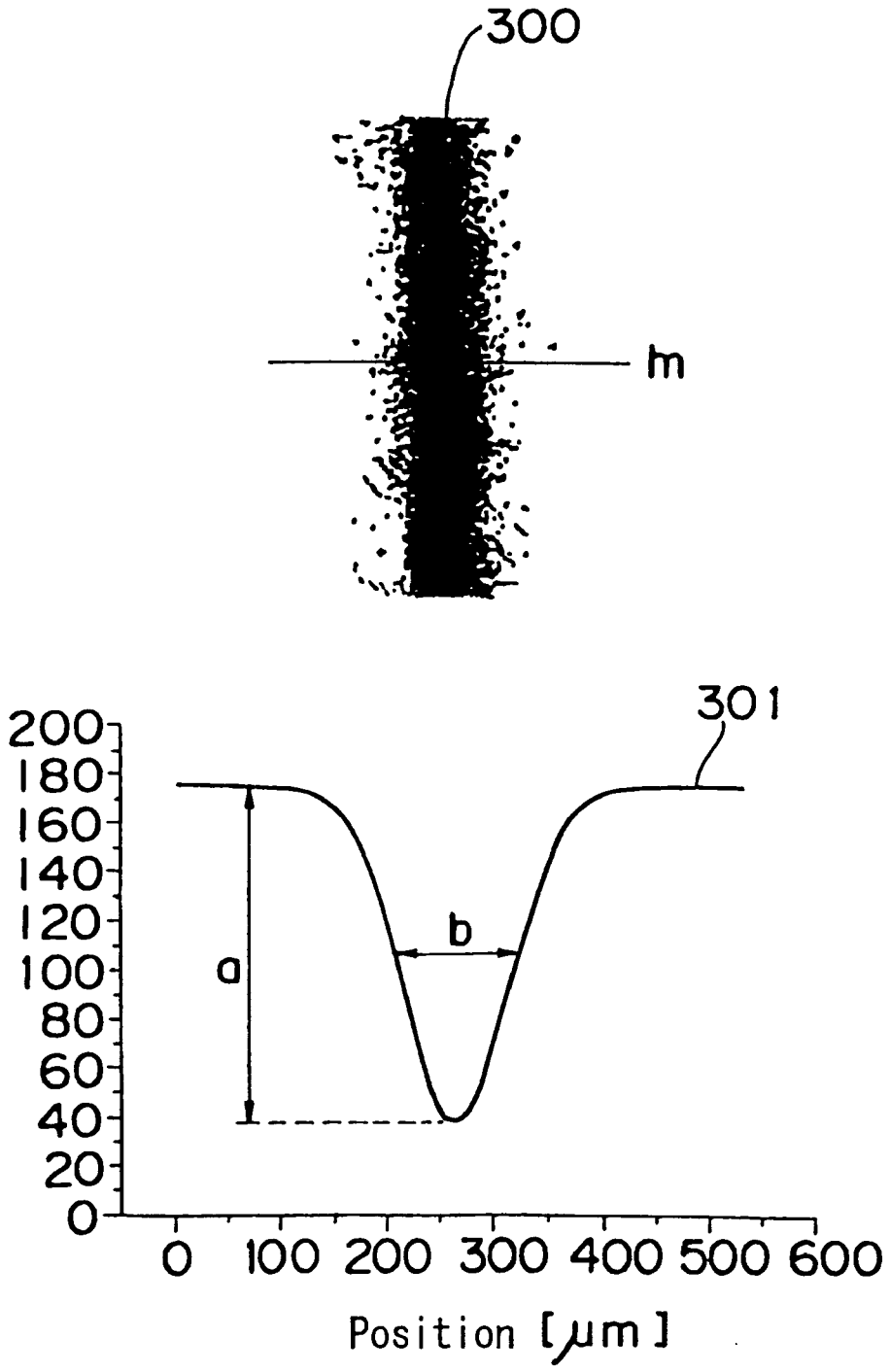
FIG. 11 is a conceptual view that explains ranking values of converging property.

For example, as illustrated in FIG. 11, in the luminance profile 301 approximated by the Gauss function at an arbitrary position m on an enlarged line 300, the "max-min" of the luminance represents a difference (a) between the maximum value and the minimum value of the luminance curve. And the half-value width of the Gauss function indicates the length (width of the position) (μm) (b) at the time when the luminance is not more than "minimum value of the luminance curve+"max-min"/2 of the luminance".

(Separating property)

The saturated minimum electric field intensity E (V/μm) was found, and an evaluation of the separating property was made based upon this value. When E was not more than 12 V/μm, this case was evaluated as "○"; and when E was above 12 V/μm, this case was evaluation as "X". The saturated minimum electric field intensity E (V/μm) was measured as following manner. A solid black image was printed longitudinally on normal paper of A-4 size while the electric field (V/μm) between the intermediate roller and the flexible printed circuit board was varied, and the amount of toner supply onto the printed paper was measured. The amount of toner supply (amount of adhesion) (M(g)/S($cm^2$)) increased in proportion to an increase of the electric field when the electric field (V/μm) was relatively small. However, when the electric field was beyond a predetermined level, no change appeared. In this manner, the saturated minimum electric field intensity E is defined as an electric field that allows the amount of toner supply (amount of adhesion) to stop increasing. Here, the electric field (V/μm) was represented by Vp/Lk, and this can be changed by appropriately selecting Vp(V) and/or Lk (μm). The printing apparatus and its setting conditions were the same as those used in the evaluation on FPC stain, except that Vp and Lk were appropriately changed.

Tables 3 to 5 show the results of the measurements and the results of the evaluations. Here, when the average quantity of charge and the deviation satisfied the expressions of the first invention, "OK" was given in the column indicating conformity in the charging characteristics, and when they did not satisfy the expressions, "NG" was given therein.

TABLE 3

| Toner type | Average particle size $D_{50}$ (μm) |
|---|---|
| 1-1 | 7.85 |
| 1-2 | 7.85 |
| 1-3 | 7.85 |
| 1-4 | 7.85 |
| 1-5 | 7.85 |
| 1-6 | 7.85 |
| 1-7 | 9.57 |
| 1-8 | 8.45 |
| 1-9 | 8.65 |
| 1-10 | 8.65 |
| 1-11 | 8.21 |

TABLE 4

In the case of blade pressure of 6 g/mm

| | Charging characteristics | | | | | | |
|---|---|---|---|---|---|---|---|
| Toner type | Quantity of charge (μC/g) | Deviation | Conformity | Tailing | FPC stain | Converging property | Separating property |
| 1-1 | −15.37 | 23.01 | NG | ○ | ○ | X | X |
| 1-2 | −8.35 | 20.25 | OK | ○ | ○ | ○ | ○ |

TABLE 4-continued

In the case of blade pressure of 6 g/mm

| | Charging characteristics | | | | | | |
|---|---|---|---|---|---|---|---|
| Toner type | Quantity of charge (μC/g) | Deviation | Conformity | Tailing | FPC stain | Converging property | Separating property |
| 1-3 | −8.82 | 14.45 | OK | ○ | ○ | ○ | ○ |
| 1-4 | −9.67 | 24.12 | OK | ○ | ○ | ○ | ○ |
| 1-5 | −12.89 | 25.20 | OK | ○ | ○ | ○ | ○ |
| 1-6 | −6.43 | 16.66 | OK | ○ | ○ | ○ | ○ |
| 1-7 | −7.77 | 39.41 | NG | X | X | ○ | ○ |
| 1-8 | −7.09 | 19.17 | OK | ○ | ○ | ○ | ○ |
| 1-10 | −7.44 | 32.03 | OK | ○ | ○ | ○ | ○ |
| 1-11 | −16.51 | 23.85 | NG | ○ | X | X | X |

TABLE 5

In the case of blade pressure of 4 g/mm

| | Charging characteristics | | | | | | |
|---|---|---|---|---|---|---|---|
| Toner type | Quantity of charge (μC/g) | Deviation | Conformity | Tailing | FPC stain | Converging property | Separating property |
| 1-1 | −10.77 | 14.03 | NG | ○ | X | X | ○ |
| 1-2 | −5.53 | 9.22 | OK | ○ | ○ | ○ | ○ |
| 1-3 | −3.30 | 9.18 | OK | ○ | ○ | ○ | ○ |
| 1-4 | −3.48 | 18.43 | NG | X | X | ○ | ○ |
| 1-6 | −2.20 | 10.55 | OK | ○ | ○ | ○ | ○ |
| 1-7 | −2.72 | 6.00 | OK | ○ | ○ | ○ | ○ |
| 1-8 | −14.19 | 15.46 | NG | ○ | X | X | X |
| 1-10 | −4.06 | 6.95 | OK | ○ | ○ | ○ | ○ |
| 1-11 | −18.00 | 22.25 | NG | ○ | X | X | X |

Experimental Example 2

(Toners 2-1 to 2-12)

Toners were obtained by the same processes as that of the toner 1-1 with the exception of the followings. A binder resin, a wax, a colorant, a charge control agent and a post-treatment agent shown in Tables 6 and 7 were used by the amounts described therein. The mixing time of the post-treatment agent and the pulverizing conditions (including the model, etc. of the pulverizer) were altered on demand, and the particles having large particle sizes were omitted by using a DS classifier (made by Nippon Pneumatic MFG).

TABLE 6

| Toner type | Binder resin (parts) | Wax (parts) | Colorant (parts) | Charge control agent (parts) |
|---|---|---|---|---|
| 2-1 | PESA (40)<br>PESB (60) | 800P (2)<br>TS200 (2) | MOGUL L (8) | Formula (I) (2) |
| 2-2 | PESA (40)<br>PESB (60) | 800P (2)<br>TS200 (2) | MOGUL L (8) | Formula (I) (2) |
| 2-3 | PESA (40)<br>PESB (60) | 800P (2)<br>TS200 (2) | MOGUL L (8) | Formula (I) (2) |
| 2-4 | PESA (40)<br>PESB (60) | 800P (2)<br>TS200 (2) | MOGUL L (8) | Formula (I) (2) |
| 2-5 | PESA (40)<br>PESB (60) | 800P (2)<br>TS200 (2) | MOGUL L (8) | Formula (I) (2) |
| 2-6 | PESA (40)<br>PESB (60) | 800P (2)<br>TS200 (2) | MOGUL L (8) | Formula (I) (2) |
| 2-7 | PESA (40) | 800P (2) | MOGUL L (8) | Formula (I) (2) |

TABLE 6-continued

| Toner type | Binder resin (parts) | Wax (parts) | Colorant (parts) | Charge control agent (parts) |
|---|---|---|---|---|
| | PESB (60) | TS200 (2) | | |
| 2-8 | PESA (40) | 800P (2) | MOGUL L (8) | Formula (I) (2) |
| | PESB (60) | TS200 (2) | | |
| 2-9 | PESA (40) | 800P (2) | MOGUL L (8) | Formula (I) (2) |
| | PESB (60) | TS200 (2) | | |
| 2-10 | PESE (100) | TS200 (3) | RAVEN1255 (6) | S-34 (2) |
| 2-11 | PESE (100) | TS200 (3) | RAVEN1255 (6) | VP-434 (2) |
| 2-12 | PESA (40) | 800P (2) | MOGUL L (8) | Formula (I) (2) |
| | PESB (60) | TS200 (2) | | |

TABLE 7

| | Post-treatment agent | | | | | | Mixing time |
|---|---|---|---|---|---|---|---|
| | Silica | | | | Titanium oxide | | (titanium/silica/ |
| Toner type | TS500 (weight %) | R972 (weight %) | R974 (weight %) | NAX50 (weight %) | STT30A (weight %) | STT30A-FS10J (weight %) | conductivity treatment agent) (min.) |
| 2-1 | 0.5 | — | — | — | 1 | — | 3/3 |
| 2-2 | 0.5 | — | — | — | 1 | — | 3/3 |
| 2-3 | 0.25 | — | — | 1 | 1 | — | 3/3 |
| 2-4 | 0.5 | — | — | — | 1 | — | 3/3 |
| 2-5 | — | — | — | 2 | 1 | — | 3/3 |
| 2-6 | 0.5 | — | — | — | 1 | — | 3/3 |
| 2-7 | 0.25 | — | — | 1 | 1 | — | 3/3 |
| 2-8 | 0.5 | — | — | — | 1 | — | 3/3 |
| 2-9 | 0.5 | — | — | — | 1 | — | 3/3 |
| 2-10 | 0.5 | — | — | — | 1 | — | 3/3 |
| 2-11 | 0.5 | — | — | — | — | 1 | 3/3 |
| 2-12 | 0.5 | — | — | — | 1 | — | 3/3 |

Here, in Tables 6 and 7, abbreviations are explained as follows: Here, with respect to the same abbreviations as used in Tables 1 and 2, explanations thereof are omitted. RAVEN1255 represents RAVEN1255 (made by Colombia Carbon Corp.).

The toner average particle size ($D_{50}$) was measured in the same manner as Experimental Example 1. The ratio of content (weight %) of toner particles having a particle size of not less than 9 $\mu$m was obtained by measuring the distribution of toner particle sizes. The distribution of toner particle sizes was measured by setting them in a Coulter Counter Multisizer (made by Coulter Co., Ltd.). Moreover, the toner charging characteristics (the average quantity of charge, deviation), FPC stain, tailing, converging property and separating property were evaluated in the same manner as Experimental Example 1.

Tables 8 to 10 show the results of the measurements and the results of the evaluations. Here, when the average quantity of charge and the deviation satisfied the expressions of the second invention, "OK" was given in the column indicating conformity in the charging characteristics, and when they did not satisfy the expressions, "NG" was given therein.

TABLE 8

| Toner type | Average particle size $D_{50}$ ($\mu$m) | Ratio of particles having a particle size of not less than 9 $\mu$m (weight %) |
|---|---|---|
| 2-1 | 6.65 | 6.3 |
| 2-2 | 7.95 | 20.0 |
| 2-3 | 7.95 | 20.0 |
| 2-4 | 7.25 | 12.0 |
| 2-5 | 7.25 | 12.0 |
| 2-6 | 7.78 | 17.5 |
| 2-7 | 7.78 | 17.5 |
| 2-8 | 7.58 | 16.9 |
| 2-9 | 6.87 | 6.1 |

TABLE 8-continued

| Toner type | Average particle size $D_{50}$ ($\mu$m) | Ratio of particles having a particle size of not less than 9 $\mu$m (weight %) |
|---|---|---|
| 2-10 | 7.41 | 14.5 |
| 2-11 | 7.41 | 14.5 |
| 2-12 | 7.04 | 6.8 |

TABLE 9

| | In the case of blade pressure of 6 g/mm | | | | | | |
|---|---|---|---|---|---|---|---|
| | Charging characteristics | | | | | | |
| Toner type | Quantity of charge ($\mu$C/g) | Deviation | Conformity | Tailing | FPC stain | Converging property | Separating property |
| 2-1 | −6.13 | 32.89 | NG | X | X | ○ | ○ |
| 2-2 | −4.54 | 19.68 | OK | ○ | ○ | ○ | ○ |
| 2-3 | −4.80 | 14.04 | OK | ○ | ○ | ○ | ○ |
| 2-6 | −13.51 | 17.73 | OK | ○ | ○ | ○ | ○ |
| 2-7 | −14.27 | 13.65 | NG | ○ | ○ | ○ | X |
| 2-8 | −9.99 | 17.76 | OK | ○ | ○ | ○ | ○ |
| 2-9 | −10.77 | 21.43 | OK | ○ | ○ | ○ | ○ |

TABLE 9-continued

| In the case of blade pressure of 6 g/mm | | | | | | | |
|---|---|---|---|---|---|---|---|
| | Charging characteristics | | | | | | |
| Toner type | Quantity of charge (μC/g) | Deviation | Conformity | Tailing | FPC stain | Converging property | Separating property |
| 2-10 | −6.54 | 22.21 | OK | ○ | ○ | ○ | ○ |
| 2-11 | −7.54 | 30.21 | OK | ○ | ○ | ○ | ○ |
| 2-12 | −7.34 | 14.04 | OK | ○ | ○ | ○ | ○ |

TABLE 10

| In the case of blade pressure of 4 g/mm | | | | | | | |
|---|---|---|---|---|---|---|---|
| | Charging characteristics | | | | | | |
| Toner type | Quantity of charge (μC/g) | Deviation | Conformity | Tailing | FPC stain | Converging property | Separating property |
| 2-1 | −10.91 | 12.16 | NG | ○ | X | ○ | ○ |
| 2-2 | −1.84 | 8.38 | OK | ○ | ○ | ○ | ○ |
| 2-4 | −6.20 | 9.50 | OK | ○ | ○ | ○ | ○ |
| 2-5 | −3.62 | 18.99 | NG | X | X | ○ | ○ |
| 2-6 | −3.92 | 7.29 | OK | ○ | ○ | ○ | ○ |
| 2-8 | −1.81 | 4.66 | OK | ○ | ○ | ○ | ○ |

Experimental Example 3

(Toners 3-1 to 3-9)

Toner particles were obtained by the same process as that of the toner 1-1 with the exception of the followings. A binder resin, wax, a colorant and a charge control agent shown in Tables 11 and 12 were used by the amounts described therein, and that the pulverizing conditions (including the model, etc. of the pulverizer) were altered on demand. To these toner particles was added 0.1% by weight of hydrophobic silica (TS-500; made by Cabot Corp.) (pretreatment agent) and this was mixed to obtain a toner. The obtained toner was subjected to a surface-modifying treatment by means of the surface modifying device shown in FIG. 10 (Surfusing System made by Nippon Pneumatic MFG.). Then a post-treatment agent and a conductivity-treatment agent shown in Table 12 were added to the obtained toner particles by the amounts as described therein, and mixed in a manner as described therein. Thereafter, these were filtered through a vibration sieve (mesh size: 106 μm) to obtain a toner. Here, the setting conditions (for example, the maximum temperature, residence time, powder dispersion density, cooling-air temperature and cooling-water temperature, etc.) of the surface-modifying device were appropriately changed.

TABLE 11

| Toner type | Binder resin (parts) | Wax (parts) | Colorant (parts) | Charge control agent (parts) |
|---|---|---|---|---|
| 3-1 | PESA (40)<br>PESB (60) | 800P (2)<br>TS200 (2) | MOGUL L (8) | Formula (I) (2) |
| 3-2 | PESA (40)<br>PESB (60) | 800P (2)<br>TS200 (2) | MOGUL L (8) | Formula (I) (2) |
| 3-3 | PESA (40)<br>PESB (60) | 800P (2)<br>TS200 (2) | MOGUL L (8) | Formula (I) (2) |
| 3-4 | PESA (40)<br>PESB (60) | 800P (2)<br>TS200 (2) | MOGUL L (8) | Formula (I) (2) |
| 3-5 | PESC (100) | Carnauba (1.5)<br>TS200 (1) | MOGUL L (5) | S-34 (2) |
| 3-6 | PESC (100) | Carnauba (1.5)<br>TS200 (1) | MOGUL L (5) | S-34 (2) |
| 3-7 | PESC (100) | Carnauba (1.5)<br>TS200 (1) | MOGUL L (5) | S-34 (2) |
| 3-8* | PESD (100) | — | C. I. 184 (3) | E-84 (2) |
| 3-9* | PESD (100) | — | C. I. 184 (3) | E-84 (2) |
| 3-10 | Described in the text | | | |

*Upon producing toners 3–8 and 3–9, a colorant was applied as a pigment master batch in combination with a binder resin.

TABLE 12

| Toner type | Post-treatment agent (weight %) | Post-treatment agent: Silica TS500 (weight %) | Post-treatment agent: Silica NX50 (weight %) | Post-treatment agent: Titanium oxide STT30A (weight %) | Conductivity-treatment agent: Carbon XC72R (weight %) | Conductivity-treatment agent: ZnO 23K (weight %) | Mixing time (titanium/silica/conductivity treatment agent) (min.) |
|---|---|---|---|---|---|---|---|
| 3-1 | 0.1 | 0.5 | — | 1 | — | — | 3/3 |
| 3-2 | 0.1 | 0.5 | — | 1 | — | — | 3/3 |
| 3-3 | Prepared by mixing toner 3-1 (50% by weight) and toner 1-2 (50% by weight) | | | | | | |
| 3-4 | 0.1 | — | 0.5 | 1 | — | — | 3/3 |
| 3-5 | 0.1 | 0.5 | — | 1 | — | — | 3/3 |
| 3-6 | 0.1 | 0.5 | — | 1 | — | — | 3/3 |
| 3-7 | Prepared by mixing toner 1-8 (50% by weight) and toner 3-5 (50% by weight) | | | | | | |
| 3-8 | 0.1 | 0.8 | — | — | — | — | 1.5 |
| 3-9 | 0.1 | 0.8 | — | — | — | — | 1.5 |
| 3-10 | — | 0.8 | — | — | — | — | 1.5 |

Here, with respect to the abbreviations in Tables 11 and 12, explanations thereof are omitted since they are the same as those in Tables 1 and 2 or Tables 6 and 7.

(Toner 3-10)

The carbon black (trade name: Monaque 120 made by Cabot Corp.)(7 parts), the charge control agent (trade name: Spilon Black TRH made by Hodogaya Kagaku K.K.)(0.5 part), divinylbenzene (0.3 part), t-dodecyl mercaptan (1.0 part), and t-butylperoxy-2-ethylhexanoate (4 part) were dispersed into the monomer component comprising styrene (70 parts) and n-butyl methacrylate (30 parts) at room temperature to obtain a uniform mixture by means of the bead mill. On the other hand, to a solution formed by dissolving 9.8 parts of magnesium chloride (water-soluble polyhydric metal salt) in 250 parts of ion exchange water was stirred and gradually dropped an aqueous solution formed by dissolving 6.9 parts of sodium hydroxide (hydroxide of alkali metal) in 50 parts of ion exchange water, thereby preparing a dispersion solution of magnesium hydroxide colloid (metal hydroxide colloid which is slightly soluble in water).

To the dispersion of magnesium hydroxide colloid thus obtained was added the polymerizable monomer composition, and this mixture was stirred under a high shearing force at 12000 rpm by using a TK-type homomixer, thereby granulating droplets of the polymerizable monomer composition. The aqueous dispersion containing the polymerizable monomer composition thus granulated was loaded into a reactor with stirring blades, and this was subjected to a polymerization reaction at 90° C., and after having been polymerized for 8 hours, this was cooled, thereby obtaining an aqueous dispersion solution of colored polymer particles. The aqueous dispersion solution of colored polymer particles thus obtained was washed with acid in a system having a reduced pH of not more than 4 by using sulfuric acid while being stirred, and water was separated therefrom through filtration. Then, the obtained solid was again formed into a slurry by newly adding 500 parts of ion exchange water thereto, and washed with water. Thereafter, the solid was subjected to dehydration and washing with water several times so that solid components were filtrated and separated, and then dried by a drier for one day and night at 45° C., thereby obtaining toner particles. A post-treatment agent as shown in Table 12 was added to these toner particles, and mixed to obtain toner 3-10.

The toner average particle size ($D_{50}$) was measured in the same manner as in Experimental Example 1. The toner average degree of roundness was measured by a flow-type particle image analyzer (FPIA-2000; made by Toa Iyoudenshi K.K.). More specifically, a suspension containing the toner particles was set in the analyzer, and the particles were passed through a sensor band of a photographic section having a plate shape so that the images of the particles were optically picked up by a CCD camera and thus measured. Moreover, the toner charging characteristics (the average quantity of charge and deviation), FPC stain, tailing, converging property and separating property were evaluated in the same manner as in Experimental Example 1. Here, the setting conditions of the measuring device of the average quantity of charge and the distribution deviation of quantity of charge were the same as those described in the explanation of the toner of the third invention.

Tables 13 to 15 show the results of the measurements and the results of the evaluations. Here, when the average quantity of charge and the deviation satisfied the expressions of the third invention, "OK" was given in the column indicating conformity in the charging characteristics, and when they did not satisfy the expressions, "NG" was given therein.

TABLE 13

| Toner type | Average particle size $D_{50}$ (μm) | Average degree of roundness |
|---|---|---|
| 3-1 | 9.10 | 0.970 |
| 3-2 | 9.10 | 0.970 |
| 3-3 | 8.70 | 0.970 |
| 3-4 | 9.10 | 0.961 |
| 3-5 | 9.60 | 0.954 |
| 3-6 | 9.60 | 0.954 |
| 3-7 | 9.60 | 0.954 |
| 3-8 | 9.44 | 0.992 |
| 3-9 | 9.44 | 0.992 |
| 3-10 | 9.68 | 0.992 |

TABLE 14

In the case of blade pressure of 6 g/mm

| | Charging characteristics | | | | | | |
|---|---|---|---|---|---|---|---|
| Toner type | Quantity of charge (μC/g) | Deviation | Conformity | Tailing | FPC stain | Converging property | Separating property |
| 3-1 | −6.10 | 26.48 | OK | ○ | ○ | ○ | ○ |
| 3-2 | −6.80 | 17.50 | OK | ○ | ○ | ○ | ○ |
| 3-3 | −10.80 | 26.50 | OK | ○ | ○ | ○ | ○ |
| 3-4 | −7.13 | 39.53 | NG | X | X | ○ | ○ |
| 3-5 | −7.20 | 20.61 | OK | ○ | ○ | ○ | ○ |
| 3-6 | −7.20 | 13.61 | OK | ○ | ○ | ○ | ○ |
| 3-7 | −10.20 | 16.61 | OK | ○ | ○ | ○ | ○ |
| 3-8 | −2.71 | 18.90 | NG | X | X | ○ | ○ |
| 3-9 | −2.10 | 5.22 | OK | ○ | ○ | ○ | ○ |
| 3-10 | −17.03 | 17.41 | NG | ○ | ○ | X | X |

TABLE 15

In the case of blade pressure of 4 g/mm

| | Charging characteristics | | | | | | |
|---|---|---|---|---|---|---|---|
| Toner type | Quantity of charge (μC/g) | Deviation | Conformity | Tailing | FPC stain | Converging property | Separating property |
| 3-1 | −2.29 | 10.71 | OK | ○ | ○ | ○ | ○ |
| 3-2 | −3.50 | 13.10 | OK | ○ | ○ | ○ | ○ |
| 3-5 | −2.48 | 8.39 | OK | ○ | ○ | ○ | ○ |
| 3-9 | −5.44 | 7.83 | OK | ○ | ○ | ○ | ○ |
| 3-10 | −12.27 | 12.13 | NG | ○ | ○ | X | ○ |

Experimental Example 4

(Toners 4-1 to 4-25)

Toner particles were obtained by the same process as that of the toner 1-1 with the exception of the followings. A binder resin, a wax, a colorant, and a charge control agent shown in Tables 16 and 19 were used by the amounts described in these tables. The pulverizing conditions (including the model, etc. of the pulverizer) were altered on demand. The particles having large particle sizes were omitted by using a DS classifier (made by Nippon Pneumatic MFG). To these toner particles was added 1.0% by weight of hydrophobic silica (TS-500; made by Cabozyl Corp.) (pre-treatment agent) and this blend was mixed to obtain a toner. The resulting toner was subjected to a surface-modifying treatment by using a surface-modifying device shown in FIG. 10 (Surfusing System (made by Nippon Pneumatic MFG.), and to the resulting toner particles was then added a post-treatment agent shown in Tables 18 and 19 by the amounts as described therein, and the blend was mixed in a manner as described therein. Thereafter, these particles were filtered through a vibration sieve (106 μm mesh) to obtain a toner. Here, the setting conditions (for example, the maximum temperature, residence time, powder dispersion density, cooling-air temperature and cooling-water temperature, etc.) of the surface-modifying device were appropriately changed.

TABLE 16

| Toner type | Binder (parts) | Wax (parts) | Colorant (parts) | Charge control agent (parts) |
|---|---|---|---|---|
| 4-1 | PESA (40)<br>PESB (60) | 800P (2)<br>TS200 (2) | MOGUL L (8) | Formula (I) (2) |
| 4-2 | PESA (40)<br>PESB (60) | 800P (2)<br>TS200 (2) | MOGUL L (8) | Formula (I) (2) |
| 4-3 | PESA (40)<br>PESB (60) | 800P (2)<br>TS200 (2) | MOGUL L (8) | Formula (I) (2) |
| 4-4 | PESA (40)<br>PESB (60) | 800P (2)<br>TS200 (2) | MOGUL L (8) | Formula (I) (2) |
| 4-5 | PESA (40)<br>PESB (60) | 800P (2)<br>TS200 (2) | MOGUL L (8) | Formula (I) (2) |
| 4-6 | PESA (40)<br>PESB (60) | 800P (2)<br>TS200 (2) | MOGUL L (8) | Formula (I) (2) |
| 4-7 | PESA (40)<br>PESB (60) | 800P (2)<br>TS200 (2) | MOGUL L (8) | Formula (I) (2) |
| 4-8 | PESA (40)<br>PESB (60) | 800P (2)<br>TS200 (2) | MOGUL L (8) | Formula (I) (2) |
| 4-9 | PESA (40)<br>PESB (60) | 800P (2)<br>TS200 (2) | MOGUL L (8) | Formula (I) (2) |
| 4-10 | PESA (40)<br>PESB (60) | 800P (2)<br>TS200 (2) | MOGUL L (8) | Formula (I) (2) |
| 4-11 | PESA (40)<br>PESB (60) | 800P (2)<br>TS200 (2) | MOGUL L (8) | Formula (I) (2) |
| 4-12 | PESA (40)<br>PESB (60) | 800P (2)<br>TS200 (2) | MOGUL L (8) | Formula (I) (2) |
| 4-13 | PESA (40)<br>PESB (60) | 800P (2)<br>TS200 (2) | MOGUL L (8) | Formula (I) (2) |
| 4-14 | PESA (40)<br>PESB (60) | 800P (2)<br>TS200 (2) | MOGUL L (8) | Formula (I) (2) |
| 4-15 | PESA (40)<br>PESB (60) | 800P (2)<br>TS200 (2) | MOGUL L (8) | Formula (I) (2) |
| 4-16 | PESA (40)<br>PESB (60) | 800P (2)<br>TS200 (2) | MOGUL L (8) | Formula (I) (2) |

TABLE 17

| Toner type | Binder resin (parts) | Wax (parts) | Colorant (parts) | Charge control agent (parts) |
|---|---|---|---|---|
| 4-17 | PESA (40)<br>PESB (60) | 800P (2)<br>TS200 (2) | MOGUL L (8) | Formula (I) (2) |
| 4-18 | PESA (40)<br>PESB (60) | 800P (2)<br>TS200 (2) | MOGUL L (8) | Formula (I) (2) |
| 4-19 | PESA (40)<br>PESB (60) | 800P (2)<br>TS200 (2) | MOGUL L (8) | Formula (I) (2) |
| 4-20 | PESA (40)<br>PESB (60) | 800P (2)<br>TS200 (2) | MOGUL L (8) | Formula (I) (2) |
| 4-21 | PESA (40)<br>PESB (60) | 800P (2)<br>TS200 (2) | MOGUL L (8) | Formula (I) (2) |
| 4-22 | PESA (40)<br>PESB (60) | 800P (2)<br>TS200 (2) | MOGUL L (8) | Formula (I) (2) |
| 4-23 | PESA (40)<br>PESB (60) | 800P (2)<br>TS200 (2) | MOGUL L (8) | Formula (I) (2) |
| 4-24 | PESA (40)<br>PESB (60) | 800P (2)<br>TS200 (2) | MOGUL L (8) | Formula (I) (2) |
| 4-25 | PESC (100) | Carnauba (1.5)<br>TS200 (1) | MOGUL L (5) | S-34 (2) |
| 4-26 | | Described in the text | | |
| 4-27 | | Described in the text | | |
| 4-28 | | Described in the text | | |
| 4-29 | | Described in the text | | |
| 4-30 | | Described in the text | | |
| 4-31 | | Described in the text | | |

TABLE 18

| | | Post-treatment agent | | | | | | | | |
|---|---|---|---|---|---|---|---|---|---|---|
| | Pre- | | | | | | Titanium oxide | | | |
| | treatment | Silica | | | | | STT30A- | | | Mixing time |
| Toner type | agent (wt %) | TS500 (wt %) | R972 (wt %) | R974 (wt %) | NAX50 (wt %) | NAX90 (wt %) | STT30A (wt %) | FS10J (wt %) | $SrTiO_3$ (wt %) | (titanium/silica) (min.) |
| 4-1 | 1.0 | 0.5 | — | — | — | — | 1 | — | — | 3/3 |
| 4-2 | Prepared by mixing toner 4-1 (50% by weight) and toner 2-4 (50% by weight) | | | | | | | | | |
| 4-3 | 1.0 | 0.5 | — | — | — | — | 1 | — | — | 3/3 |
| 4-4 | 1.0 | 0.5 | — | — | — | — | 1 | — | 0.5 | 3/3 |
| 4-5 | 1.0 | — | 0.5 | — | — | — | 1 | — | 0.5 | 3/3 |
| 4-6 | 1.0 | — | 0.5 | — | — | — | 1 | — | — | 3/3 |
| 4-7 | 1.0 | — | 0.5 | — | — | — | 1 | — | 0.5 | 3/3 |
| 4-8 | 1.0 | 0.5 | — | — | — | — | — | 1 | — | 3/3 |
| 4-9 | 1.0 | 0.5 | — | — | — | — | 1 | — | — | 3/3 |
| 4-10 | 1.0 | 0.5 | — | — | — | — | 1 | — | — | 3/3 |
| 4-11 | 1.0 | 0.5 | — | — | — | — | 1 | — | — | 3/3 |
| 4-12 | 1.0 | 0.5 | — | — | — | — | 1 | — | — | 3/3 |
| 4-13 | 1.0 | 0.5 | — | — | — | — | 1 | — | — | 3/3 |
| 4-15 | 1.0 | 0.5 | — | — | — | — | 1 | — | — | 3/3 |
| 4-16 | 1.0 | — | 0.5 | — | — | — | 1 | — | — | 3/3 |

TABLE 19

| Toner type | Pre-treatment agent (wt %) | Post-treatment agent: Silica TS500 (wt %) | R972 (wt %) | R974 (wt %) | NAX50 (wt %) | NAX90 (wt %) | Titanium oxide STT30A (wt %) | STT30A-FS10J (wt %) | Conductivity-treatment agent Carbon XC72R (wt %) | Mixing time (titanium/silica/conductivity-treatment agent) (min.) |
|---|---|---|---|---|---|---|---|---|---|---|
| 4-17 | 1.0 | — | — | 0.5 | — | — | 1 | — | — | 3/3 |
| 4-18 | 1.0 | — | — | — | 0.5 | — | 1 | — | — | 3/3 |
| 4-19 | 1.0 | — | — | — | — | 0.5 | 1 | — | — | 3/3 |
| 4-20 | 1.0 | 0.5 | — | — | — | — | — | 1 | — | 3/3 |
| 4-21 | 1.0 | — | 0.5 | — | — | — | — | 1 | — | 3/3 |
| 4-22 | 1.0 | — | — | 0.5 | — | — | — | 1 | — | 3/3 |
| 4-23 | 1.0 | — | — | — | 0.5 | — | — | 1 | — | 3/3 |
| 4-24 | 1.0 | — | — | — | — | 0.5 | — | 1 | — | 3/3 |
| 4-25 | 1.0 | 0.5 | — | — | — | — | 1 | — | — | 3/3 |
| 4-26 | — | 0.8 | — | — | — | — | — | — | — | 3 |
| 4-27 | — | 0.5 | — | — | — | — | — | 1 | — | 3/3 |
| 4-28 | — | 0.5 | — | — | — | — | 1 | — | — | 3/3 |
| 4-29 | — | 0.25 | — | — | 1 | — | 1 | — | — | 3/3 |
| 4-30 | — | 0.5 | — | — | — | — | 1 | — | 1 | 5/3/3 |
| 4-31 | — | 0.5 | — | — | — | — | 1 | — | — | 3/3 |

Here, in Tables 16 through 19, abbreviations are explained as follows: Here, with respect to the same abbreviations as used in Tables 1 and 2, Tables 6 and 7, and Tables 11 and 12, explanations thereof are omitted. NAX 90 represents hydrophobic silica (NAX 90; made by Nippon Aerosil K.K.), and $SrTiO_3$ represents strontium titanate (SW-100; made by Titan Kogyo K.K.).

(Toners 4-26 to 4-31)

Methyl ethyl ketone (650 parts) was loaded into a reactor, and heated to 80° C., and to this solvent was dropped a mixture having a ratio of contents as described below in approximately two hours. The reaction was carried out under a nitrogen gas flow.

| | |
|---|---|
| Acrylic acid | 77 parts |
| Styrene | 600 parts |
| Acrylic acid-2-ethylhexyl | 143 parts |
| Methyl methacrylate | 180 parts |
| "Perbutyl O" (made by Nihon Yushi K. K.) | 8 parts |
| Methyl ethyl ketone | 20 parts |

Four hours after completion of dropping the above-mentioned mixture, two parts of Perbutyl O was added to the reaction solution, and for every four-hour intervals, two parts of Perbutyl O was further added thereto, and this mixture was maintained at 80° C. for 24 hours while the reaction was continued. After completion of the reaction, the reaction mixture was diluted by methyl ethyl ketone so that its solid resin component constitutes 50%, thereby obtaining a solution of a copolymer having an average molecular weight of 52,000. This was a methyl ethyl ketone solution of the resin that can have a self-water-dispersing property of anion type through neutralization.

To 700 parts of the above-mentioned resin solution which was adjusted to have a concentration of non-volatile components of 50% was added 38.8 parts of carbon black (Elftex-8 made by Cabot Corp.) and this blend was stirred and mixed so as to be dispersed. Next, to 100 parts of this mixture were added 10 parts of an aqueous solution of 1 N sodium hydroxide (NaOH) and 13 parts of isopropyl alcohol, and to the obtained mixture was dropped 150 parts of water while being stirred so as to bring about a phase-inversion of emulsion. Thus, globular black resin particles were formed.

Next, the organic solvent was removed by distillation under reduced pressure so that an aqueous dispersion was obtained. An aqueous solution of 1 N hydrochloric acid was added to the dispersion to adjust a pH of the dispersion to 2.5. The resulting water slurry was processed by a centrifugal separator so as to remove fine particles, and this water slurry was allowed to pass through a filter (made by Chisso Filter K.K.) so as to remove large particles. The resulting wet cake after filtration and washing with water was heated and dried under reduced pressure while being stirred, thereby obtaining toner particles (ratio of pigment content: 10%) having a styrene-(meth) acrylic resin as its binding resin. Here, upon manufacturing the respective toners, the above-mentioned conditions, for example, the stirring time, stirring speed, etc. were appropriately altered. Post-treatment agents and conductivity-treatment agents listed in Table 19 were added to the toner particles in a manner as described therein, and mixed, thereby obtaining respective toners.

The toner average particle size ($D_{50}$) was measured in the same manner as Experimental Example 1. Moreover, the average degree of roundness and the ratio of content (weight %) of toner particles having a particle size of not less than 9 $\mu$m were measured in the same manner as Experimental Examples 3 and 2. Moreover, the toner charging characteristics (the average quantity of charge, deviation), FPC stain, tailing, converging property and separating property were evaluated in the same manner as Experimental Example 1. Here, the above-mentioned evaluation was only made in the case of a blade pressure of 6 g/mm. The setting conditions of the measuring device of the average quantity of charge and distribution deviation of quantity of charge were the same as those used in the explanation of the toner of the third invention.

Tables 20 to 23 show the results of the measurements and the results of the evaluations. Here, when the average quantity of charge and the deviation satisfied the expressions of the fourth invention, "OK" was given in the column indicating conformity in the charging characteristics, and when they did not satisfy the expressions, "NG" was given therein.

TABLE 20

| Toner type | Average particle size $D_{50}$ (μm) | Average degree of roundness | Ratio of content of toner particles having a particle size of not less than 9 μm (weight %) |
|---|---|---|---|
| 4-1 | 7.36 | 0.970 | 12.7 |
| 4-2 | 7.53 | 0.960 | 20.0 |
| 4-3 | 7.48 | 0.970 | 16.0 |
| 4-4 | 7.54 | 0.970 | 16.2 |
| 4-5 | 7.54 | 0.970 | 16.2 |
| 4-6 | 7.43 | 0.970 | 15.4 |
| 4-7 | 7.49 | 0.970 | 15.5 |
| 4-8 | 7.41 | 0.970 | 14.1 |
| 4-9 | 6.87 | 0.954 | 7.8 |
| 4-10 | 6.80 | 0.961 | 7.4 |
| 4-11 | 6.82 | 0.964 | 7.2 |
| 4-12 | 6.86 | 0.971 | 8.2 |
| 4-13 | 6.98 | 0.982 | 9.9 |
| 4-14 | 7.17 | 0.987 | 13.4 |
| 4-15 | 6.80 | 0.961 | 7.2 |
| 4-16 | 6.80 | 0.961 | 7.2 |

TABLE 21

| Toner type | Average particle size $D_{50}$ (μm) | Average degree of roundness | Ratio of content of toner particles having a particle size of not less than 9 μm (weight %) |
|---|---|---|---|
| 4-17 | 6.80 | 0.961 | 7.2 |
| 4-18 | 6.80 | 0.961 | 7.2 |
| 4-19 | 6.80 | 0.961 | 7.2 |
| 4-20 | 6.80 | 0.961 | 7.2 |
| 4-21 | 6.80 | 0.961 | 7.2 |
| 4-22 | 6.80 | 0.961 | 7.2 |
| 4-23 | 6.80 | 0.961 | 7.2 |
| 4-24 | 6.80 | 0.961 | 7.2 |
| 4-25 | 7.62 | 0.963 | 20.0 |
| 4-26 | 7.27 | 0.992 | 8.8 |
| 4-27 | 7.27 | 0.992 | 8.8 |
| 4-28 | 5.04 | 0.989 | 0.8 |
| 4-29 | 5.04 | 0.984 | 0.8 |
| 4-30 | 5.04 | 0.984 | 0.8 |
| 4-31 | 7.01 | 0.992 | 3.3 |

TABLE 22

In the case of blade pressure of 6 g/mm,

| | Charging characteristics | | | | | | |
|---|---|---|---|---|---|---|---|
| Toner type | Quantity of charge (μC/g) | Deviation | Conformity | Tailing | FPC stain | Converging property | Separating property |
| 4-1 | −5.96 | 10.95 | OK | ○ | ○ | ○ | ○ |
| 4-2 | −5.01 | 21.96 | OK | ○ | ○ | ○ | ○ |
| 4-3 | −3.50 | 7.56 | OK | ○ | ○ | ○ | ○ |
| 4-4 | −3.86 | 10.08 | OK | ○ | ○ | ○ | ○ |
| 4-5 | −2.86 | 13.07 | OK | ○ | ○ | ○ | ○ |
| 4-6 | −5.39 | 8.11 | OK | ○ | ○ | ○ | ○ |
| 4-7 | −4.36 | 9.18 | OK | ○ | ○ | ○ | ○ |
| 4-8 | −8.34 | 14.38 | OK | ○ | ○ | ○ | ○ |
| 4-9 | −12.73 | 13.54 | OK | ○ | ○ | ○ | ○ |
| 4-10 | −9.21 | 11.09 | OK | ○ | ○ | ○ | ○ |
| 4-11 | −8.39 | 15.27 | OK | ○ | ○ | ○ | ○ |
| 4-12 | −7.17 | 15.90 | OK | ○ | ○ | ○ | ○ |
| 4-13 | −8.25 | 18.54 | OK | ○ | ○ | ○ | ○ |

TABLE 22-continued

In the case of blade pressure of 6 g/mm,

| | Charging characteristics | | | | | | |
|---|---|---|---|---|---|---|---|
| Toner type | Quantity of charge (μC/g) | Deviation | Conformity | Tailing | FPC stain | Converging property | Separating property |
| 4-14 | −6.52 | 11.48 | OK | ○ | ○ | ○ | ○ |
| 4-15 | −7.53 | 13.40 | OK | ○ | ○ | ○ | ○ |
| 4-16 | −5.68 | 8.41 | OK | ○ | ○ | ○ | ○ |

TABLE 23

In the case of blade pressure of 6 g/mm,

| | Charging characteristics | | | | | | |
|---|---|---|---|---|---|---|---|
| Toner type | Quantity of charge (μC/g) | Deviation | Conformity | Tailing | FPC stain | Converging property | Separating property |
| 4-17 | −9.44 | 8.72 | OK | ○ | ○ | ○ | ○ |
| 4-18 | −6.71 | 10.35 | OK | ○ | ○ | ○ | ○ |
| 4-19 | −12.55 | 13.05 | OK | ○ | ○ | ○ | ○ |
| 4-20 | −9.68 | 21.30 | OK | ○ | ○ | ○ | ○ |
| 4-21 | −13.52 | 16.63 | OK | ○ | ○ | ○ | ○ |
| 4-22 | −11.93 | 17.51 | OK | ○ | ○ | ○ | ○ |
| 4-23 | −12.13 | 14.02 | OK | ○ | ○ | ○ | ○ |
| 4-24 | −10.56 | 13.25 | OK | ○ | ○ | ○ | ○ |
| 4-25 | −6.05 | 7.15 | OK | ○ | ○ | ○ | ○ |
| 4-26 | −18.28 | 10.39 | NG | ○ | ○ | X | X |
| 4-27 | −15.31 | 10.75 | NG | ○ | ○ | X | X |
| 4-28 | −8.31 | 39.75 | NG | X | X | ○ | ○ |
| 4-29 | −9.06 | 30.57 | OK | ○ | ○ | ○ | ○ |
| 4-30 | −5.83 | 32.89 | NG | X | X | ○ | ○ |
| 4-31 | −7.74 | 10.67 | OK | ○ | ○ | ○ | ○ |

The toner or the method of the present invention provides superior effects so that it becomes possible to prevent clogging, tailing and a reduction in the density, and also to improve the image quality, converging property and separating property.

What is claimed is:

1. A toner comprising a binder resin and a colorant, said toner being used in an image forming apparatus using a toner-jetting system, and satisfying a following relationships between an average quantity of charge (x)(μC/g) and a distribution deviation of quantity of charge (y):

$y \leqq 4.17|x|+2.68$; and $y \geqq 1.43|x|+1.13$.

2. A toner of claim 1, in which |x| is 0–60 μC/g.

3. A toner of claim 1, in which |x| is 0–40 μC/g.

4. A toner of claim 1, in which |x| is 0–20 μC/g.

5. A toner of claim 1, in which y is 0–120.

6. A toner of claim 1, in which y is 0–80.

7. A toner of claim 1, in which y is 0–40.

8. A toner of claim 1, in which the image-forming apparatus comprises (i) a toner-supporting member for supporting the toner, (ii) a back electrode which is arranged on the opposite side of the toner-supporting member at a predetermined space, (iii) a partition wall equipped with plural penetration holes for passing the toner and a recording electrode which is arranged in the neighborhood of each of the penetration holes, said penetration wall being arranged between the toner-supporting member and the back electrode, and (iv) a driver which impresses a voltage to the recording electrode in response to an image signal.

9. A toner comprising a binder resin and a colorant, said toner being used in an image forming apparatus using a toner-jetting system, and satisfying a following relationships between an average quantity of charge (x)($\mu$C/g) and a distribution deviation of quantity of charge (y):

$y \leqq 4.17|x|+2.68$; and $y \geqq 1.14|x|+1.13$, wherein a content of toner having a particle size of not less than 9 $\mu$m is not more than 20% by weight.

10. A toner of claim 9, in which |x| is 0–60 $\mu$C/g.

11. A toner of claim 9, in which |x| is 0–40 $\mu$C/g.

12. A toner of claim 9, in which |x| is 0–20 $\mu$C/g.

13. A toner of claim 9, in which y is 0–120.

14. A toner of claim 9, in which y is 0–80.

15. A toner of claim 9, in which y is 0–40.

16. A toner of claim 9, in which the image-forming apparatus comprises (i) a toner-supporting member for supporting the toner, (ii) a back electrode which is arranged on the opposite side of the toner-supporting member at a predetermined space, (iii) a partition wall equipped with plural penetration holes for passing the toner and a recording electrode which is arranged in the neighborhood of each of the penetration holes, said penetration wall being arranged between the toner-supporting member and the back electrode, and (iv) a driver which impresses a voltage to the recording electrode in response to an image signal.

17. A toner comprising a binder resin and a colorant, said toner being used in an image forming apparatus using a toner-jetting system, and having an average roundness of 0.954 to 0.992, and satisfying a following relationships between an average quantity of charge (x)($\mu$C/g) and a distribution deviation of quantity of charge (y):

$y \leqq 4.17|x|+2.68$; and $y \geqq 0.98|x|+1.13$.

18. A toner of claim 17, in which |x| is 0–60 $\mu$C/g.

19. A toner of claim 17, in which |x| is 0–40 $\mu$C/g.

20. A toner of claim 17, in which |x| is 0–20 C/g.

21. A toner of claim 17, in which y is 0–120.

22. A toner of claim 17, in which y is 0–80.

23. A toner of claim 17, in which y is 0–40.

24. A toner of claim 17, in which the image-forming apparatus comprises (i) a toner-supporting member for supporting the toner, (ii) a back electrode which is arranged on the opposite side of the toner-supporting member at a predetermined space, (iii) a partition wall equipped with plural penetration holes for passing the toner and a recording electrode which is arranged in the neighborhood of each of the penetration holes, said penetration wall being arranged between the toner-supporting member and the back electrode, and (iv) a driver which impresses a voltage to the recording electrode in response to an image signal.

25. A toner comprising a binder resin and a colorant, said toner being used in an image forming apparatus using a toner-jetting system, and having an average roundness of 0.954 to 0.992, and satisfying a following relationships between an average quantity of charge (x)($\mu$C/g) and a distribution deviation of quantity of charge (y):

$y \leqq 4.17|x|+2.68$; and $y \geqq 0.68|x|+1.13$, wherein a content of toner having a particle size of not less than 9 $\mu$m is not more than 20% by weight.

26. A toner of claim 25, in which |x| is 0–60 $\mu$C/g.

27. A toner of claim 25, in which |x| is 0–40 $\mu$C/g.

28. A toner of claim 25, in which |x| is 0–20 $\mu$C/g.

29. A toner of claim 25, in which y is 0–120.

30. A toner of claim 25, in which y is 0–80.

31. A toner of claim 25, in which y is 0–40.

32. A toner of claim 25, in which the image-forming apparatus comprises (i) a toner-supporting member for supporting the toner, (ii) a back electrode which is arranged on the opposite side of the toner-supporting member at a predetermined space, (iii) a partition wall equipped with plural penetration holes for passing the toner and a recording electrode which is arranged in the neighborhood of each of the penetration holes, said penetration wall being arranged between the toner-supporting member and the back electrode, and (iv) a driver which impresses a voltage to the recording electrode in response to an image signal.

* * * * *